US010393452B2

(12) United States Patent
Nakamura et al.

(10) Patent No.: US 10,393,452 B2
(45) Date of Patent: Aug. 27, 2019

(54) HEAT EXCHANGER

(71) Applicant: Mitsubishi Electric Corporation, Tokyo (JP)

(72) Inventors: Shin Nakamura, Tokyo (JP); Akira Ishibashi, Tokyo (JP); Tomohiko Takahashi, Tokyo (JP); Hidenari Ogata, Tokyo (JP); Ryo Terashima, Tokyo (JP); Junichi Ono, Tokyo (JP); Satoshi Ueyama, Tokyo (JP); Yohei Kato, Tokyo (JP); Tsubasa Tanda, Tokyo (JP); Kenichi Kitani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/567,393

(22) PCT Filed: May 29, 2015

(86) PCT No.: PCT/JP2015/065562
§ 371 (c)(1),
(2) Date: Oct. 18, 2017

(87) PCT Pub. No.: WO2016/194043
PCT Pub. Date: Dec. 8, 2016

(65) Prior Publication Data

US 2018/0120039 A1 May 3, 2018

(51) Int. Cl.
*F28D 1/04* (2006.01)
*F28F 17/00* (2006.01)
(Continued)

(52) U.S. Cl.
CPC ..... *F28F 17/005* (2013.01); *F25B 39/02* (2013.01); *F28D 1/05366* (2013.01);
(Continued)

(58) Field of Classification Search
CPC ..... F28D 1/05366; F28D 2021/0071; F25B 39/02
(Continued)

(56) References Cited

U.S. PATENT DOCUMENTS 5,170,842 A * 12/1992 Kato ..... F28F 1/325 165/151
5,360,060 A * 11/1994 Tanaka ..... F28F 1/325 165/151
(Continued)

FOREIGN PATENT DOCUMENTS

EP 2 657 637 A1 10/2013
EP 2 667 139 A1 11/2013
(Continued)

OTHER PUBLICATIONS

Office action dated Jun. 19, 2018 issued in corresponding JP patent application No. 2017-521317 (and English translation thereof).
(Continued)

*Primary Examiner* — Claire E Rojohn, III
(74) *Attorney, Agent, or Firm* — Posz Law Group, PLC

(57) ABSTRACT

A heat exchanger includes a fin having a plate shape and including a first region where a plurality of cutout portions are formed with intervals in a longitudinal direction that is a gravity direction, and a second region where the plurality of cutout portions are not formed in the longitudinal direction, and flat tubes attached to the plurality of cutout portions and intersecting the fin. Protruding portions protruding from a planar portion of the fin are formed on the fin, and the protruding portions each have a shape in which a first end is located in the first region and a second end is located in the second region and below the first end.

9 Claims, 52 Drawing Sheets

(51) Int. Cl.

| | |
|---|---|
| ***F25B 39/02*** | (2006.01) |
| ***F28F 1/32*** | (2006.01) |
| ***F28D 1/053*** | (2006.01) |
| *F28D 21/00* | (2006.01) |

(52) U.S. Cl.
CPC ..... *F28F 1/325* (2013.01); *F28D 2021/0071* (2013.01); *F28F 2215/12* (2013.01)

(58) Field of Classification Search
USPC ..... 165/151
See application file for complete search history.

(56) References Cited

U.S. PATENT DOCUMENTS

| | | | | |
|---|---|---|---|---|
| 6,478,079 | B1 * | 11/2002 | Kato | F28F 1/32 165/151 |
| 6,644,389 | B1 * | 11/2003 | Kang | F28F 1/325 165/146 |
| 8,505,618 | B2 * | 8/2013 | Ogawa | F28F 1/325 165/151 |
| 2005/0241813 | A1 * | 11/2005 | Choi | F28D 1/0477 165/151 |
| 2009/0050303 | A1 * | 2/2009 | Komori | F28D 1/0477 165/151 |
| 2009/0199585 | A1 * | 8/2009 | Ogawa | F28D 1/0477 62/324.2 |
| 2012/0175101 | A1 * | 7/2012 | Tamura | F24F 1/18 165/181 |
| 2013/0299153 | A1 * | 11/2013 | Jindou | F28F 1/128 165/181 |
| 2015/0101362 | A1 * | 4/2015 | Lee | F28D 1/05383 62/515 |
| 2015/0114613 | A1 * | 4/2015 | Suzuki | B21D 53/085 165/182 |
| 2016/0003547 | A1 * | 1/2016 | Okazawa | F28F 1/32 165/172 |
| 2016/0313070 | A1 * | 10/2016 | Nakado | F28F 1/126 |
| 2018/0100659 | A1 * | 4/2018 | Yoshimura | F25B 39/02 |
| 2018/0106563 | A1 * | 4/2018 | Nakamura | F28D 1/0535 |

FOREIGN PATENT DOCUMENTS

| | | | |
|---|---|---|---|
| JP | H08-247676 | A | 9/1996 |
| JP | 2012-163317 | A | 8/2012 |
| JP | 2012-233680 | A | 11/2012 |
| JP | 5523495 | B2 | 4/2014 |
| JP | 5523495 | B2 * | 6/2014 |
| JP | 2015-031478 | A | 2/2015 |
| JP | 2015-031490 | A | 2/2015 |
| JP | 2015-031491 | A | 2/2015 |

OTHER PUBLICATIONS

International Search Report of the International Searching Authority dated Aug. 11, 2015 for the corresponding international application No. PCT/JP2015/065562 (and English translation).

Extended European Search Report dated Apr. 9, 2018 issued in corresponding European patent application No. 15894078.3.

Office action dated Sep. 17, 2018 issued in corresponding Australian patent application No. 2015396674.

Office Action dated Feb. 15, 2019 issued in corresponding CN patent application No. 201580080241.4 (and English translation).

Office action dated Jan. 21, 2019 issued in corresponding KR application No. 10-2017-7033038 (and English translation thereof).

* cited by examiner

HEAT EXCHANGER

CROSS REFERENCE TO RELATED APPLICATION

This application is a U.S. national stage application of PCT/JP2015/065562 filed on May 29, 2015, the contents of which are incorporated herein by reference.

TECHNICAL FIELD

The present invention relates to a fin-and-tube heat exchanger improved in drainage performance.

BACKGROUND ART

A fin-and-tube heat exchanger has been known that includes a plurality of plate-like fins arranged with predetermined fin pitches, and a plurality of heat transfer tubes each having a flat shape. In the heat exchanger, the cross section of the heat transfer tube is formed into a substantially elliptical shape or a substantially oval shape. A plurality of cutout portions extending from one side portion of the fin toward the other side portion of the fin are formed in the fin. The plurality of heat transfer tubes are inserted into the plurality of cutout portions of the fin and extend in a direction in which the plurality of fins are arranged. Note that the ends of each heat transfer tube are connected to distribution pipes or headers that form a refrigerant passage with the heat transfer tubes. Further, the heat exchanger exchanges heat between a fluid that causes heat exchange, such as air flowing between the fins, and a fluid subjected to heat exchange, such as water and refrigerant flowing through the heat transfer tubes.

Further, in the heat exchanger, fin collars that are vertically cut and raised from the peripheral edges of the cutout portions are formed on the fin. The heat transfer tubes inserted into the cutout portions and the fin collars are bonded to each other by furnace brazing or with an adhesive, thereby improving the degree of close contact between the heat transfer tubes and the fin. Further, there is known a heat exchanger in which cut-and-raised portions called slits or louvers are formed that are open toward a direction in which air mainly flows, or a heat exchanger in which protruding portions called scratches or waffles are formed that protrude against a direction in which air mainly flows. In these heat exchangers, the surface area in which heat is exchanged is increased by the cut-and-raised portions or the protruding portions, thereby improving heat exchange performance. Moreover, there is known, for example, a heat exchanger in which a plurality of passages are formed inside a heat transfer tube, or a heat exchanger in which grooves are formed in the inner surface of a heat transfer tube. In these heat exchangers as well, the surface area in which heat is exchanged is increased by the plurality of passages or the grooves, thereby improving heat exchange performance.

Note that, when the heat exchanger operates as an evaporator, moisture in the air adheres to the heat exchanger as condensed water. In the heat exchanger, a drainage region where water adhering to the fin is drained is formed on the fin at a part other than the cutout portions. Further, the condensed water on the heat exchanger passes along the drainage region and is drained to the lower side of the fin. In this case, a water droplet adhering to a part above the cutout portion of the fin falls onto the upper surface of the heat transfer tube inserted into the cutout portion due to the gravity. Then, the water droplet runs around the end of the heat transfer tube to reach the lower surface of the heat transfer tube. Then, the water droplet falls onto the upper surface of the heat transfer tube provided on the lower side. In contrast, a water droplet adhering to the drainage region of the fin continues to descend while maintaining a constant speed because there is no obstacle such as the heat transfer tube on the lower side. That is, the descent of the water droplet adhering to a part above the cutout portion is hindered by the obstacle that is the heat transfer tube compared with the water droplet adhering to the drainage region. As a result, it takes a long period of time to reach the lower end of the heat exchanger.

Further, when the heat exchanger is mounted in an outdoor unit and operates as an evaporator, frost is formed from moisture in the air and adheres to the heat exchanger. Air-conditioning apparatuses, refrigerating apparatuses, or other apparatuses including a heat exchanger perform a defrosting operation to melt frost adhering to the heat exchanger. The frost is melted into a water droplet and the water droplet passes along the drainage region and is drained to the lower side of the fin similarly to the condensed water. Note that, when a water droplet remains above the cutout portion even after the defrosting operation is finished and a heating operation is started, the water droplet becomes frozen and grows again. Consequently, the reliability is decreased due to damage to the heat transfer tube or other cause. Further, the space around the heat transfer tube is closed by the frost, thereby influencing an increase in airflow resistance and a decrease in resistance to frost formation. Further, during the defrosting operation, it is necessary to melt the frozen water droplet as well as the frost adhering to the heat exchanger when the heat exchanger operates as an evaporator. Consequently, the comfort level is decreased due to an increase in defrosting time and the average heating capacity in a predetermined period of time is decreased due to repetition of the heating operation and the defrosting operation.

Patent Literature 1 discloses a heat exchanger in which louvers are provided between cutout portions of a fin and protruding portions are provided in a drainage region. Further, Patent Literature 2 discloses a heat exchanger in which protruding portions are provided in a drainage region. Patent Literature 2 discloses a sectorial protruding portion formed to cover the end of the cutout portion of the fin, and a linear protruding portion extending up to the other side portion of the fin.

CITATION LIST

Patent Literature

Patent Literature 1: Japanese Unexamined Patent Application Publication No. 2015-31490
Patent Literature 2: Japanese Patent No. 5523495

SUMMARY OF INVENTION

Technical Problem

In the heat exchanger disclosed in Patent Literature 1, however, a first protruding portion is provided in the drainage region of the fin. Consequently, a water droplet adhering to a part above the cutout portion of the fin falls onto the upper surface of the heat transfer tube. Thus, the descent of the water droplet is hindered by the obstacle that is the heat transfer tube. As a result, it takes a long period of time to reach the lower end of the heat exchanger. Further, in the heat exchanger disclosed in Patent Literature 2, the sectorial protruding portion temporarily guides a water droplet adhering to a part above the cutout portion to the drainage region, but then guides the water droplet to a part below the cutout portion. That is, the water droplet then falls and stagnates on the upper surface of the heat transfer tube, Thus, the descent of the water droplet is hindered by the obstacle that is the heat transfer tube. As a result, it takes a long period of time to reach the lower end of the heat exchanger. Moreover, in the heat exchanger disclosed in Patent Literature 2, the linear protruding portion extending up to the other side portion of the fin has a risk that a water droplet guided to the protruding portion may be scattered to the outside of the fin from the other side portion of the fin. Thus, the reliability of the heat exchanger is decreased. As described above, in the related-art heat exchangers, the reliability is decreased and the drainage performance for water droplets adhering to the fin is poor.

The present invention has been made to solve the problems described above, and provides a heat exchanger improved in drainage performance for water droplets adhering to a fin while securing reliability.

Solution to Problem

A heat exchanger according to an embodiment of the present invention includes a fin having a plate shape and including a first region where a plurality of cutout portions are formed with intervals in a longitudinal direction that is a gravity direction, and a second region where the plurality of cutout portions are not formed in the longitudinal direction, and flat tubes attached to the plurality of cutout portions and intersecting the fin. Protruding portions protruding from a planar portion of the fin are formed on the fin, and the protruding portions each have a shape in which a first end is located in the first region and a second end is located in the second region and below the first end.

Advantageous Effects of Invention

According to an embodiment of the present invention, water adhering to the fin is guided to the second region (drainage region) by the protruding portion. Thus, the drainage performance for water droplets adhering to the fin can be improved while reliability is secured.

DESCRIPTION OF EMBODIMENTS

Embodiments of an air-conditioning apparatus according to the present invention are described below with reference to the drawings.

Embodiment 1

Figure 1:
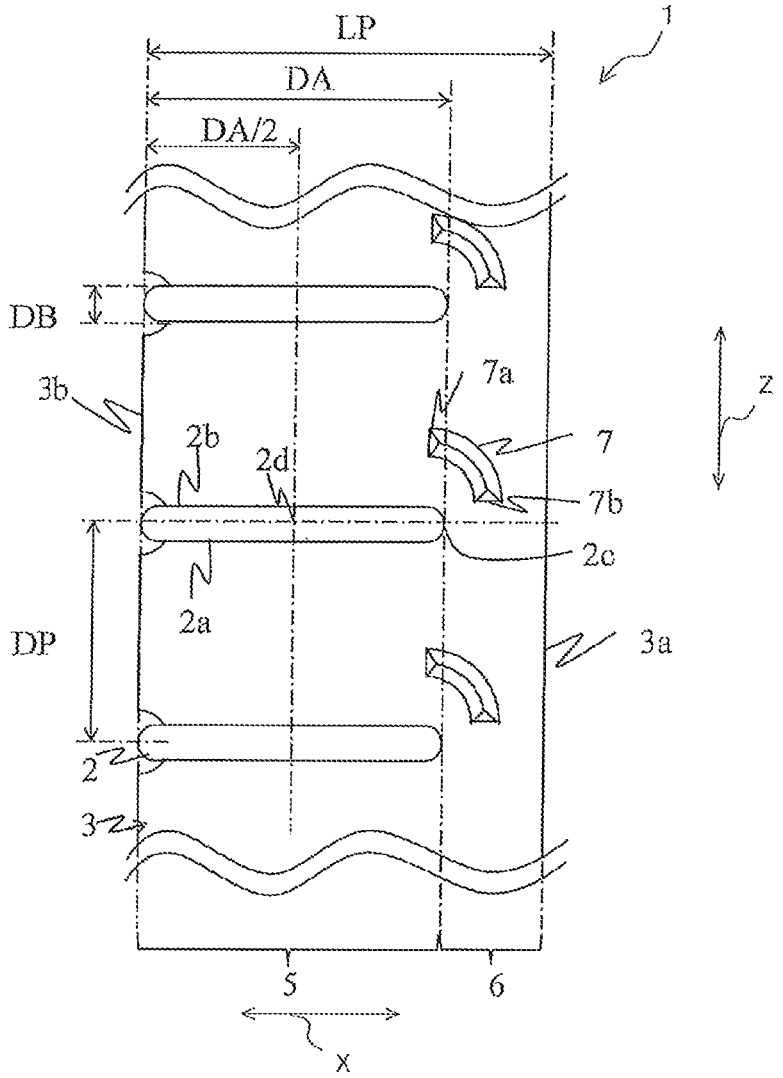
FIG. 1 is a plan view illustrating a heat exchanger 1 according to Embodiment 1 of the present invention.
Figure 2:
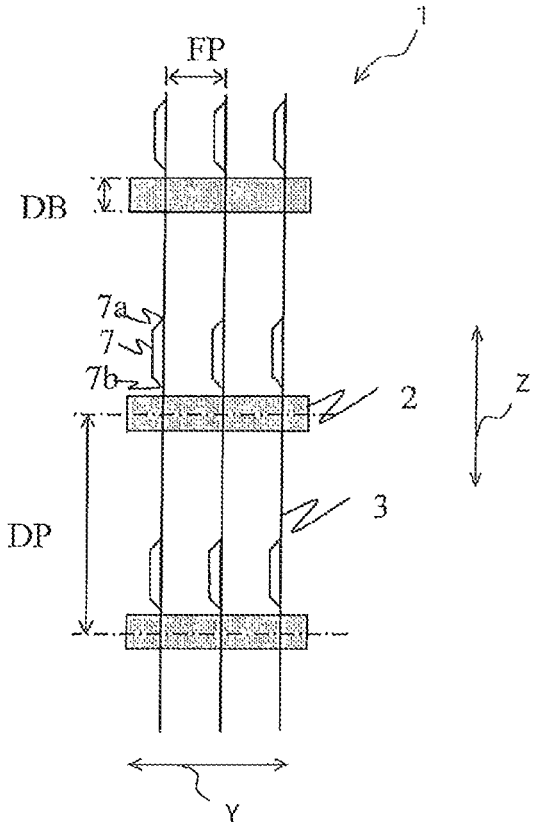
FIG. 2 is a side view illustrating the heat exchanger 1 according to Embodiment 1 of the present invention.

FIG. 1 is a plan view illustrating a heat exchanger 1 according to Embodiment 1 of the present invention, and FIG. 2 is a side view illustrating the heat exchanger 1 according to Embodiment 1 of the present invention. The heat exchanger 1 is described with reference to FIG. 1 and FIG. 2. As illustrated in FIG. 1 and FIG. 2, the heat exchanger 1 includes fins 3 and flat tubes 2. Note that FIG. 1 and FIG. 2 are enlarged views of a part where the number of the fins 3 is one to three and the number of the flat tube 2 is three.

Figure 3:
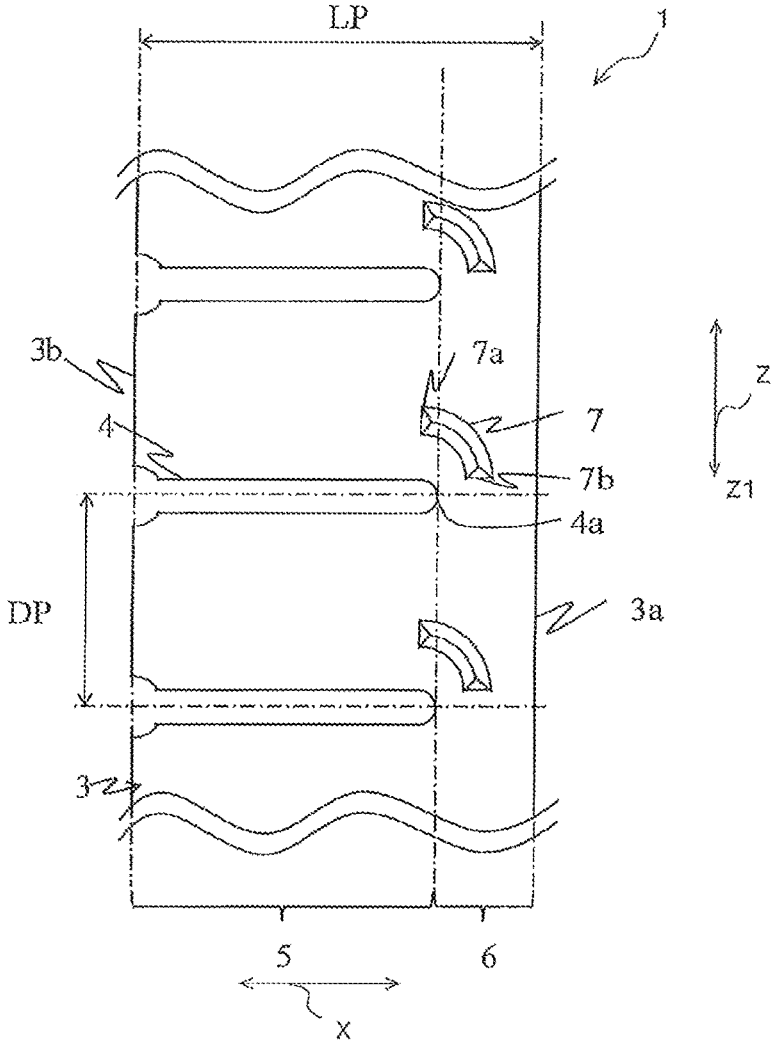
FIG. 3 is a plan view illustrating a fin 3 in Embodiment 1 of the present invention.

FIG. 3 is a plan view illustrating the fins 3 in Embodiment 1 of the present invention. As illustrated in FIG. 3, the plurality of fins 3 are arranged with intervals therebetween and are formed into a plate shape. As illustrated in FIG. 2, the plurality of fins 3 are arranged with predetermined fin pitches FP. Further, the fin 3 is provided with a cutout region 5 as a first region and a drainage region 6 as a second region. The cutout region 5 is a region where a plurality of cutout portions 4 are formed with intervals in a longitudinal direction that is a gravity direction (arrow Z direction). The cutout portion 4 extends from one side portion (first edge 3*b*) toward an other side portion (second edge 3*a*). The drainage region 6 is a region where the plurality of cutout portions 4 are not formed in the longitudinal direction (arrow Z direction). The drainage region 6 is a region ranging from the cutout region 5 to the other side portion (second edge 3*a*) of the fin 3, and is a region where water adhering to the fin 3 is drained. Note that protruding portions 7 protruding from a planar portion of the fin 3 are formed on the fin 3. Further, the fin 3 is formed of, for example, aluminum or an aluminum alloy. The width of the fin 3 is represented by LP, the width of the cutout portion 4 is represented by DA, and the distance between the adjacent cutout portions 4 is represented by DP.

The cutout portion 4 has an insertion portion 4*b* that is wide on a side close to the one side portion (first edge 3*b*) of the fin 3, thereby facilitating insertion of the fin 3 into the cutout portion 4. A deep portion 4*a* of the cutout portion 4, which is located close to the other side portion (second edge 3*a*) of the fin 3, has a semicircular shape. Note that the deep portion 4*a* of the cutout portion 4 may have an elliptical shape. A straight line extending in the gravity direction (arrow Z direction) through the terminal end of the deep portion 4*a* of the cutout portion 4 is a boundary line between the cutout region 5 and the drainage region 6.

The protruding portion 7 has a shape in which one end 7*a* that is a first end is located in the cutout region 5. Further, the protruding portion 7 has a shape in which an other end 7*b* that is a second end is located in the drainage region 6, and has a shape in which the other end 7*b* is located below the one end 7*a* (arrow Z1 direction). Moreover, the other end 7*b* is formed on the inner side with respect to the other side portion (second edge 3*a*) of the fin 3. Further, all of the protruding portions 7 adjacent to each other in the gravity direction (arrow Z direction) have the one end 7*a* formed in the cutout region 5 and the other end 7*b* formed in the drainage region 6 below the one end 7*a* in the gravity direction (arrow Z1 direction) and on the inner side with respect to the other side portion 3*a* of the fin 3.

The protruding portion 7 is formed into a smooth shape from the one end 7*a* to the other end 7*b*. That is, a locus of the protruding portion 7 from the one end 7*a* to the other end 7*b* monotonously extends downward in the gravity direction (arrow Z1 direction), or in a horizontal direction (arrow X direction) and downward in the gravity direction (arrow Z1 direction). In Embodiment 1, the protruding portion 7 is formed into an arc shape from the one end 7*a* to the other end 7*b*. The center point of the arc of the protruding portion 7 is located on the cutout region 5 side with respect to the other end 7*b*. Note that the arc of the protruding portion 7 may be a part of a perfect circle or a part of an ellipse. Further, in Embodiment 1, the plurality of protruding portions 7 are formed, but one protruding portion 7 may be formed. Moreover, all of the protruding portions 7 are formed into the same shape, but may be formed into different shapes.

Note that a clearance is secured between the protruding portion 7 and the end of the cutout portion 4 on the drainage region 6 side. Thus, the strength of the fin 3 is improved. Further, the one end 7*a* is formed at a position close to the boundary line between the cutout region 5 and the drainage region 6. Thus, the protruding portion 7 can capture water droplets running from an end 2*c* of the flat tube 2.

Figure 4:
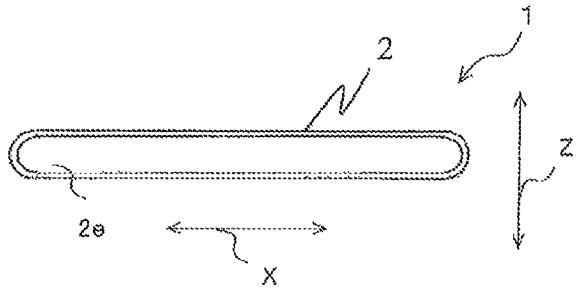
FIG. 4 is a sectional plan view illustrating a flat tube 2 in Embodiment 1 of the present invention.

FIG. 4 is a sectional plan view illustrating the flat tube 2 in Embodiment 1 of the present invention. As illustrated in FIG. 4, the flat tube 2 is attached to the plurality of cutout portions 4 of the fin 3 and intersects the fin 3. The flat tube 2 has a substantially oval cross section and has one refrigerant passage 2*e* formed in the flat tube 2. Note that the flat tube 2 may have a substantially elliptical cross section. Further, grooves may be formed in the wall surface of the refrigerant passage 2*e* of the flat tube 2, that is, the inner wall surface of the flat tube 2. Consequently, the area of contact between the inner surface of the flat tube 2 and refrigerant is increased. Thus, the heat exchange efficiency is improved. In this case, the major diameter of the flat tube 2 is represented by DA and the minor diameter of the flat tube 2 is represented by DB. Further, the flat tube 2 is formed of, for example, aluminum or an aluminum alloy.

FIG. 5A to FIG. 5E are plan views illustrating operations of a heat exchanger 200 of Comparative Example 1, and FIG. 5F to FIG. 5J are side views illustrating the operations of the heat exchanger 200 of Comparative Example 1. Next, the operations of the heat exchanger 200 of Comparative Example 1 are described for the description of operations of the heat exchanger 1 according to Embodiment 1. The heat exchanger 200 of Comparative Example 1 is different from the heat exchanger 1 according to Embodiment 1 in that the protruding portions 7 are not provided on the fin 3.

Figure 5A:
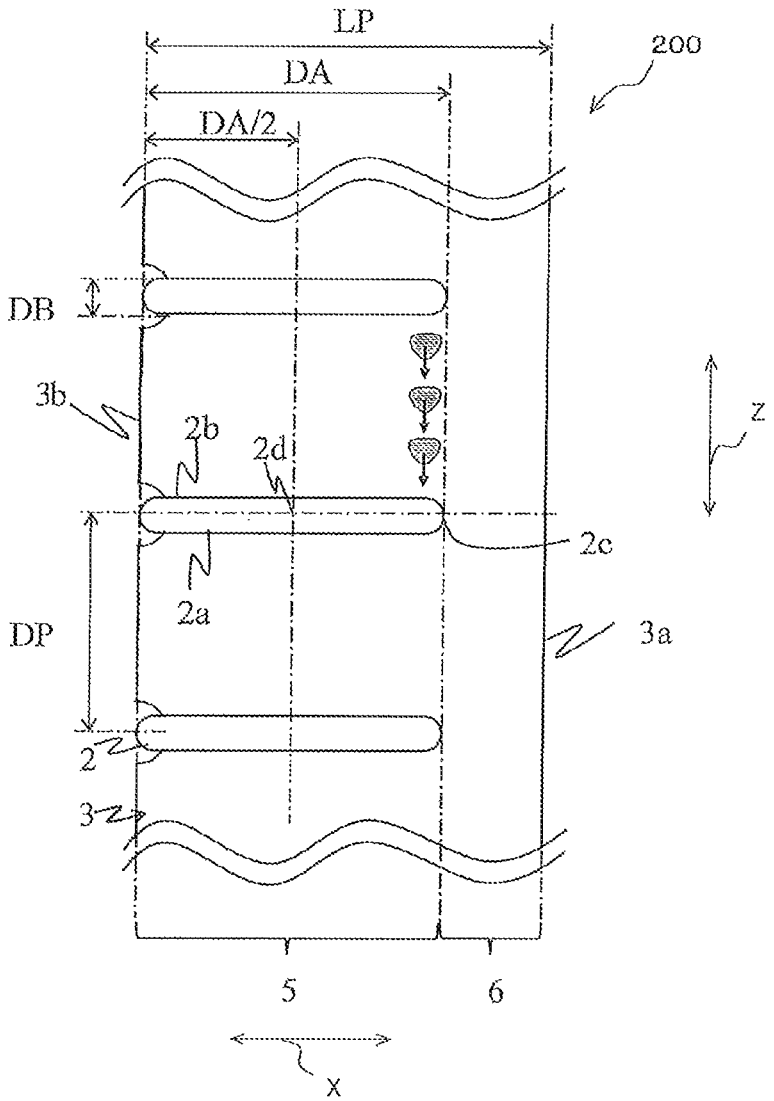
FIG. 5A is a plan view illustrating operations of a heat exchanger 200 of Comparative Example 1.
Figure 5B:
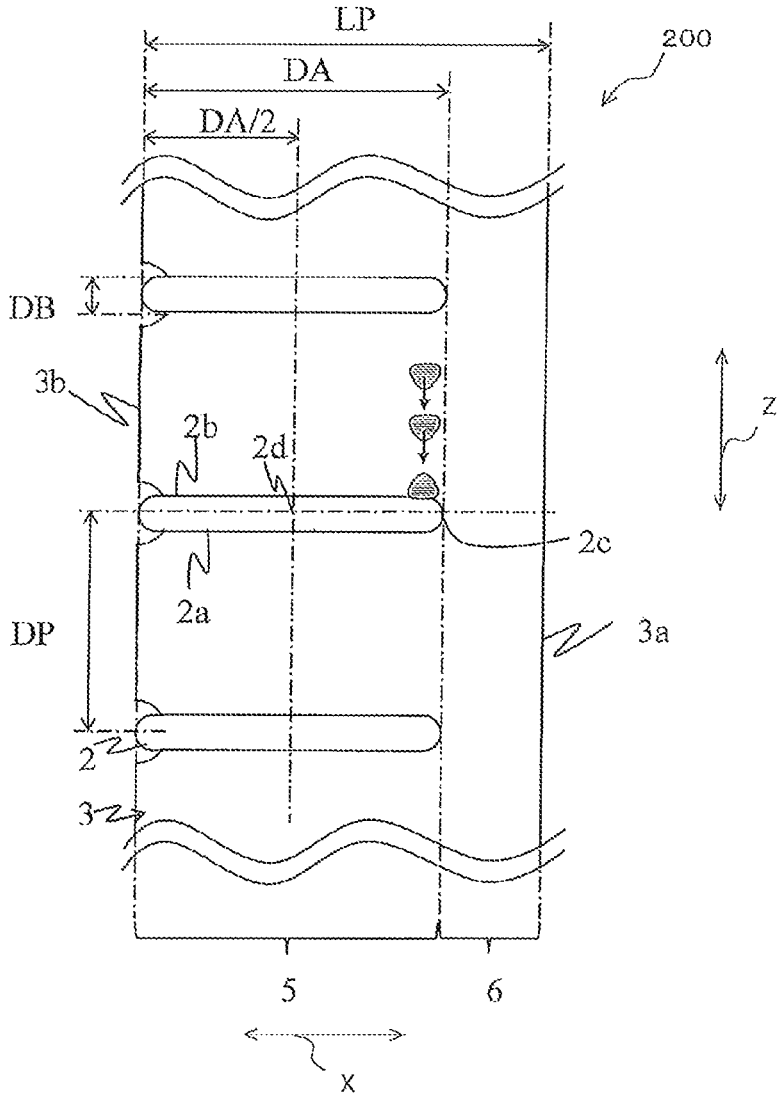
FIG. 5B is a plan view illustrating the operations of the heat exchanger 200 of Comparative Example 1.
Figure 5C:
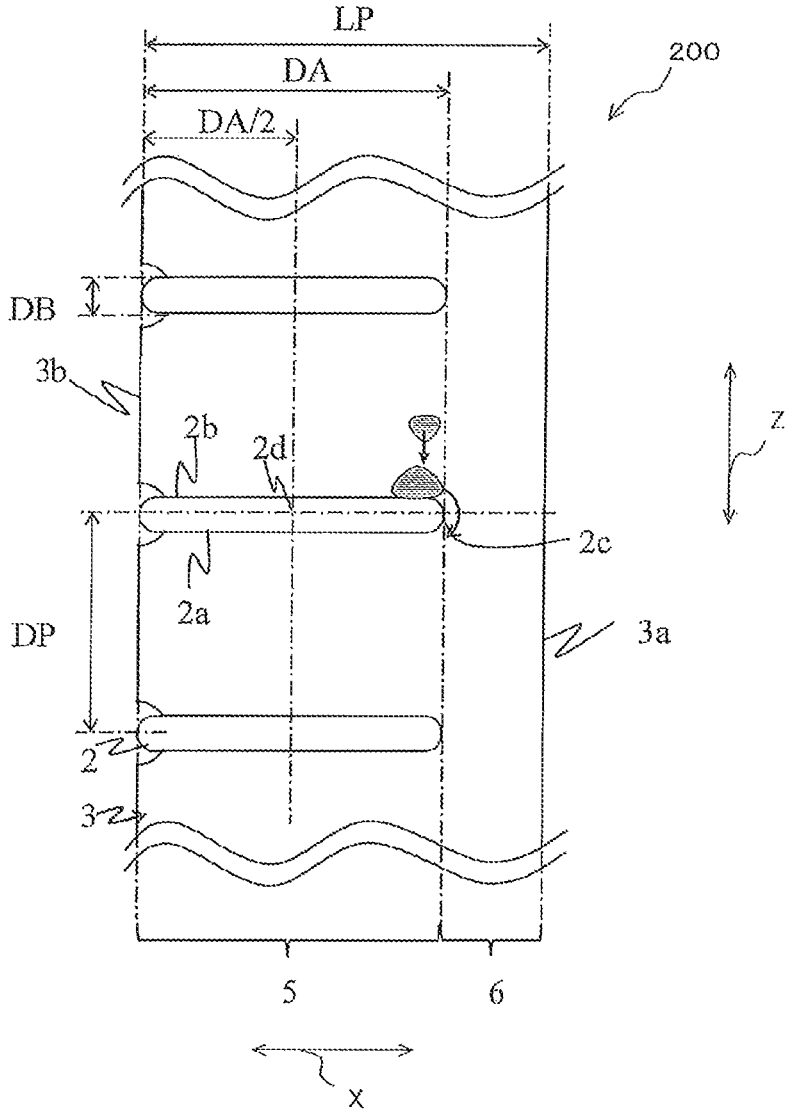
FIG. 5C is a plan view illustrating the operations of the heat exchanger 200 of Comparative Example 1.
Figure 5D:
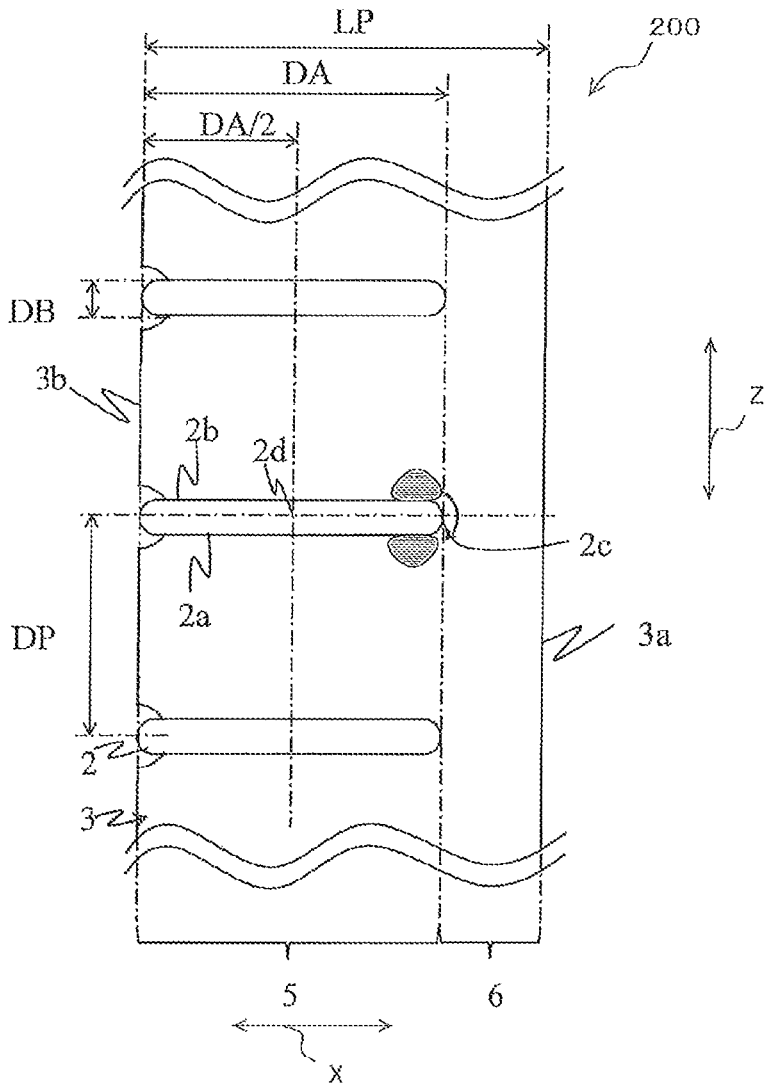
FIG. 5D is a plan view illustrating the operations of the heat exchanger 200 of Comparative Example 1.
Figure 5E:
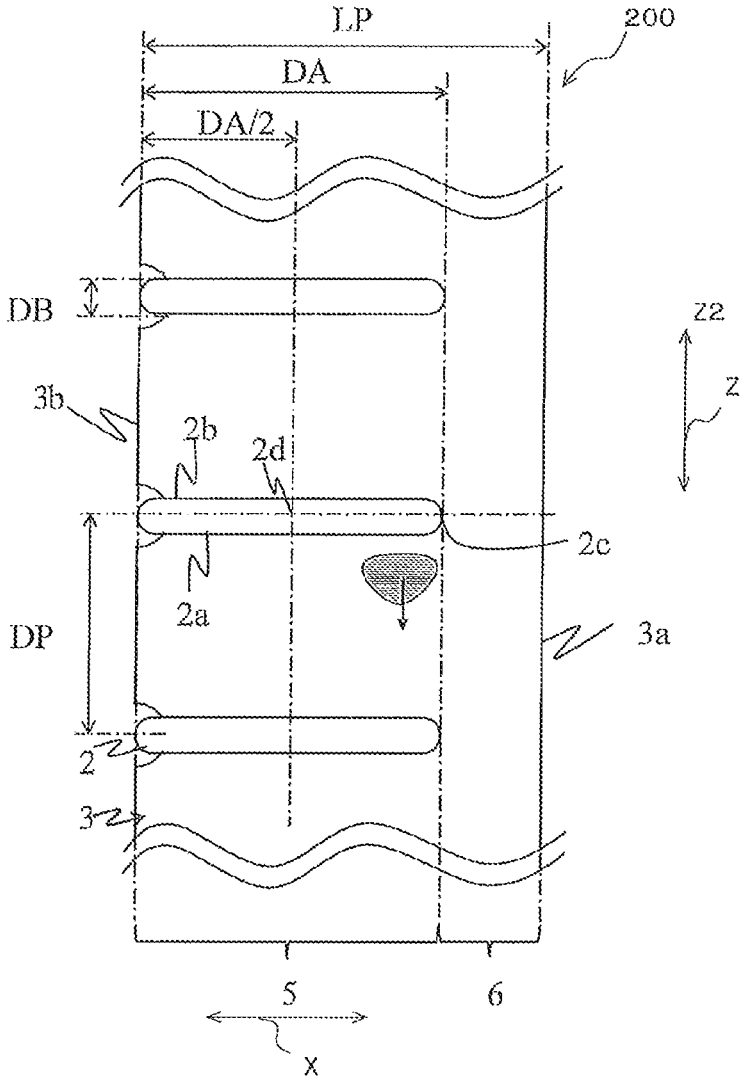
FIG. 5E is a plan view illustrating the operations of the heat exchanger 200 of Comparative Example 1.
Figure 5F:
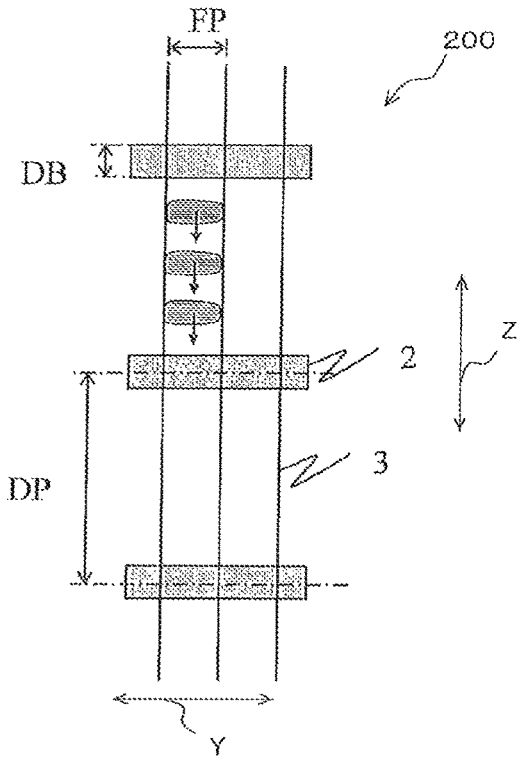
FIG. 5F is a side view illustrating the operations of the heat exchanger 200 of Comparative Example 1.
Figure 5G:
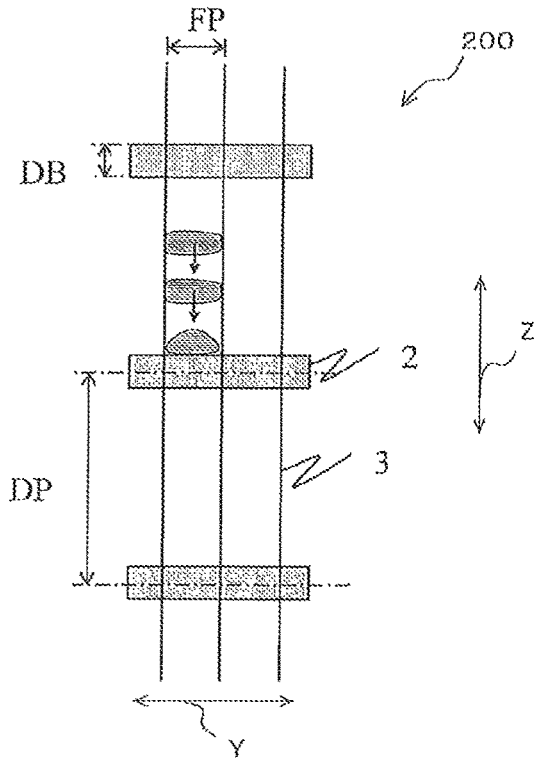
FIG. 5G is a side view illustrating the operations of the heat exchanger 200 of Comparative Example 1.
Figure 5H:
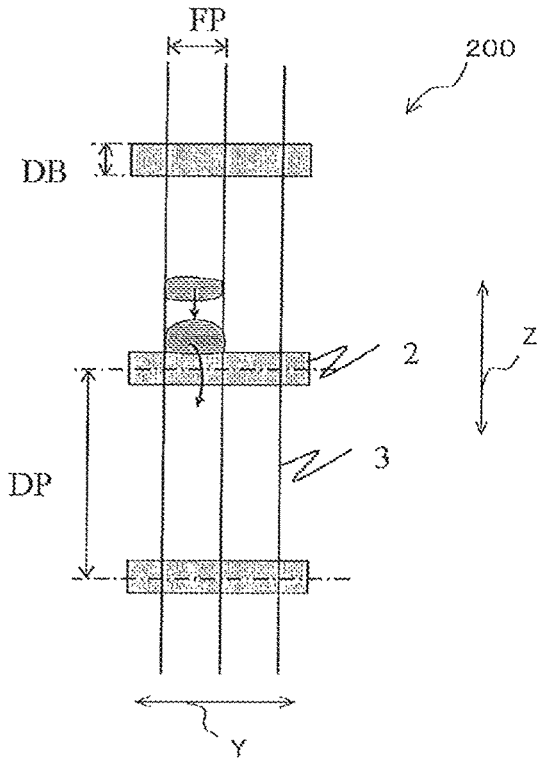
FIG. 5H is a side view illustrating the operations of the heat exchanger 200 of Comparative Example 1.
Figure 5I:
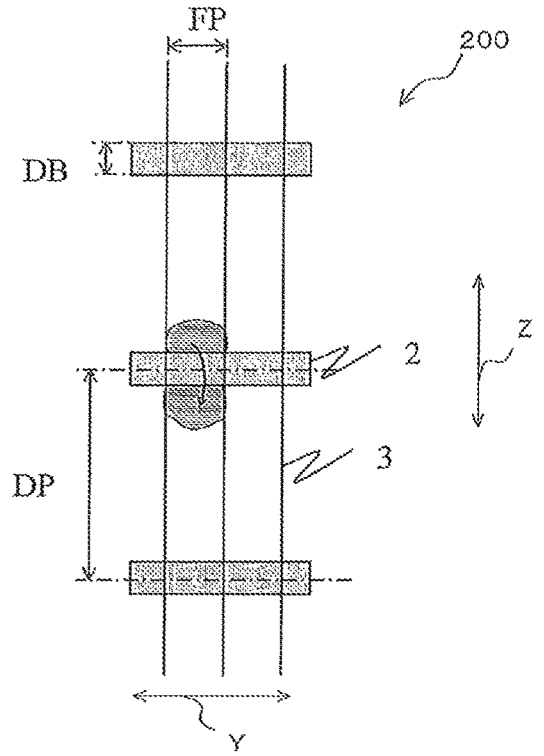
FIG. 5I is a side view illustrating the operations of the heat exchanger 200 of Comparative Example 1.

First, a process of draining a water droplet adhering to the cutout region 5 of the fin 3 is described. The water droplet adhering to the cutout region 5 descends along the cutout region 5 (FIG. 5A and FIG. 5F). Then, the descending water droplet reaches an upper surface 2*b* of the flat tube 2 (FIG. 5B and FIG. 5G). The water droplet that has reached the upper surface 2*b* of the flat tube 2 stagnates and grows on the upper surface 2*b* of the flat tube 2 (FIG. 5C and FIG. 5H). When the grown water droplet has become a certain size or larger, the water droplet runs around the semicircular end 2*c* of the flat tube 2 to reach a lower surface 2*a* of the flat tube 2 (FIG. 5D and FIG. 5I).

Figure 5J:
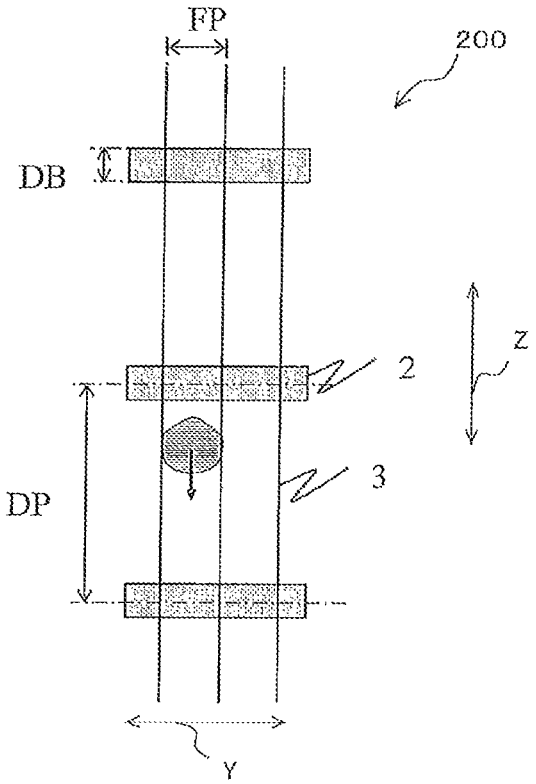
FIG. 5J is a side view illustrating the operations of the heat exchanger 200 of Comparative Example 1.

The water droplet that has run around the end 2*c* of the flat tube 2 stagnates and grows on the lower surface 2*a* of the flat tube 2 in a state in which the surface tension, gravity, static friction force, and other forces are balanced with each other. The water droplet swells on its lower side along with the growth and the influence of the gravity is increased. Then, when the gravity applied to the water droplet becomes greater than the upward force in the gravity direction (arrow Z2 direction), such as the surface tension, the water droplet is no longer influenced by the surface tension to separate and descend from the lower surface 2*a* of the flat tube 2 (FIG. 5E and FIG. 5J). As described above, as the flat tube 2 that is an obstacle is present on the lower side, the descent of the water droplet adhering to the cutout region 5 is hindered by the flat tube 2. As a result, it takes a long period of time to reach the lower end of the heat exchanger 200.

FIG. 6A to FIG. 6E are plan views illustrating the operations of the heat exchanger 200 of Comparative Example 1, and FIG. 6F to FIG. 6J are side views illustrating the operations of the heat exchanger 200 of Comparative Example 1. Next, a process of draining a water droplet adhering to the drainage region 6 of the fin 3 in the heat exchanger 200 of Comparative Example 1 is described.

Figure 6A:
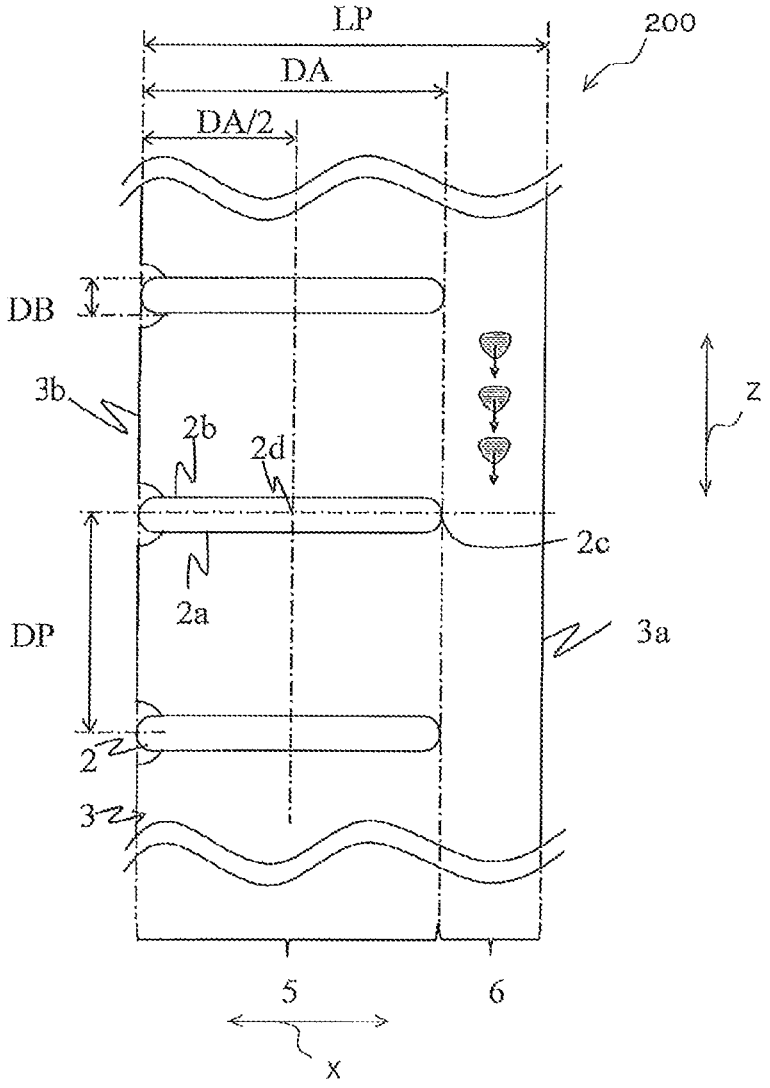
FIG. 6A is a plan view illustrating the operations of the heat exchanger 200 of Comparative Example 1.
Figure 6B:
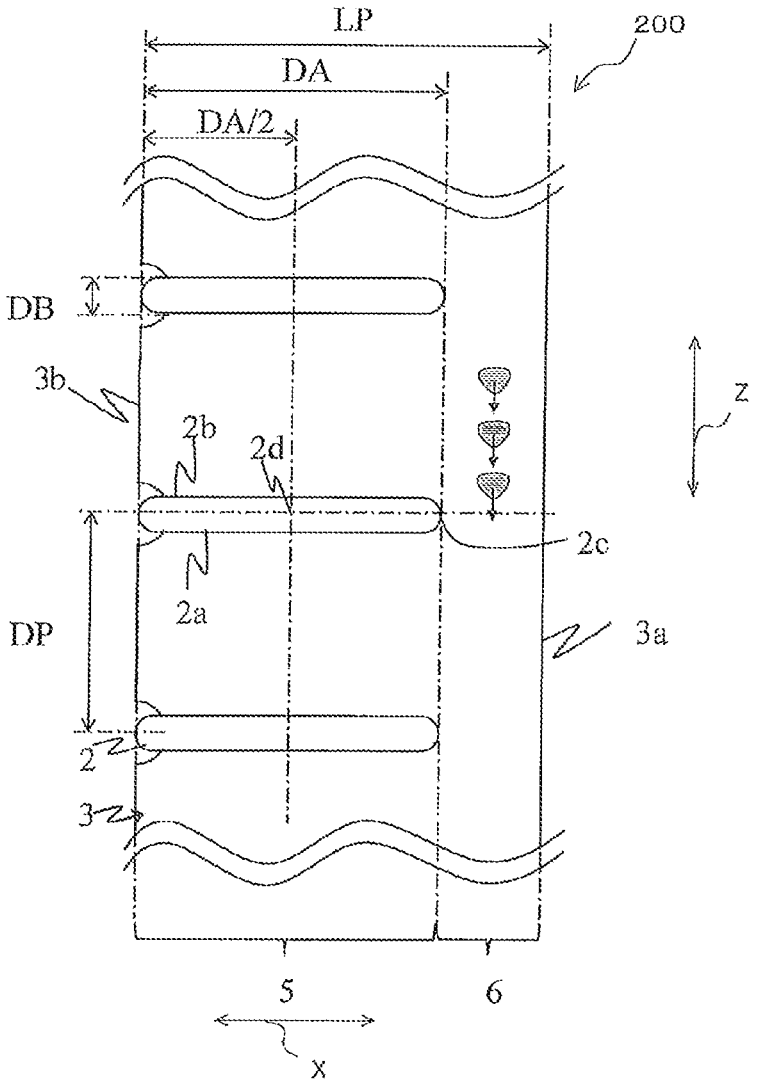
FIG. 6B is a plan view illustrating the operations of the heat exchanger 200 of Comparative Example 1.
Figure 6C:
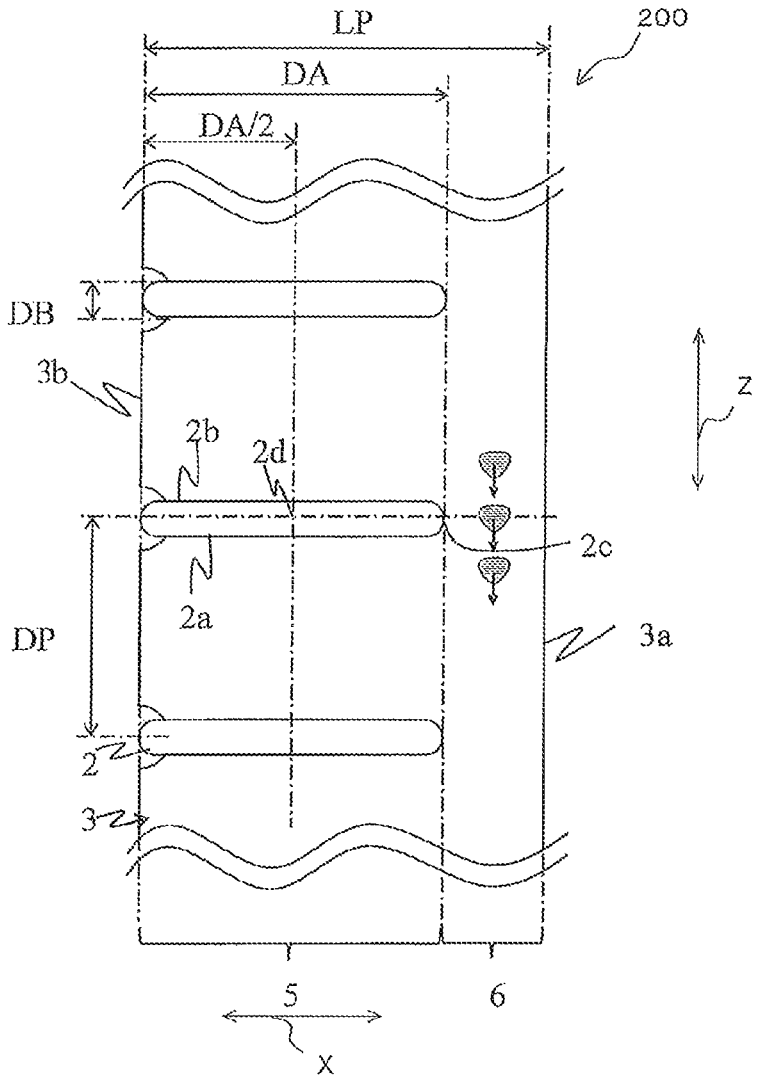
FIG. 6C is a plan view illustrating the operations of the heat exchanger 200 of Comparative Example 1.
Figure 6D:
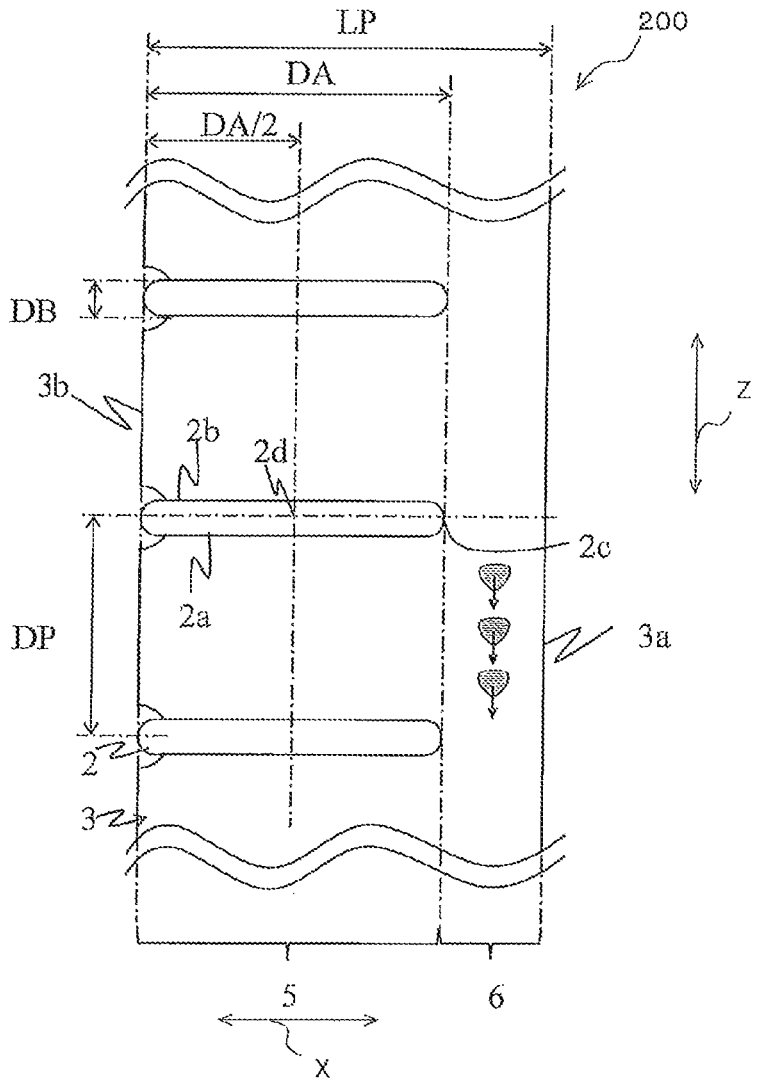
FIG. 6D is a plan view illustrating the operations of the heat exchanger 200 of Comparative Example 1.
Figure 6E:
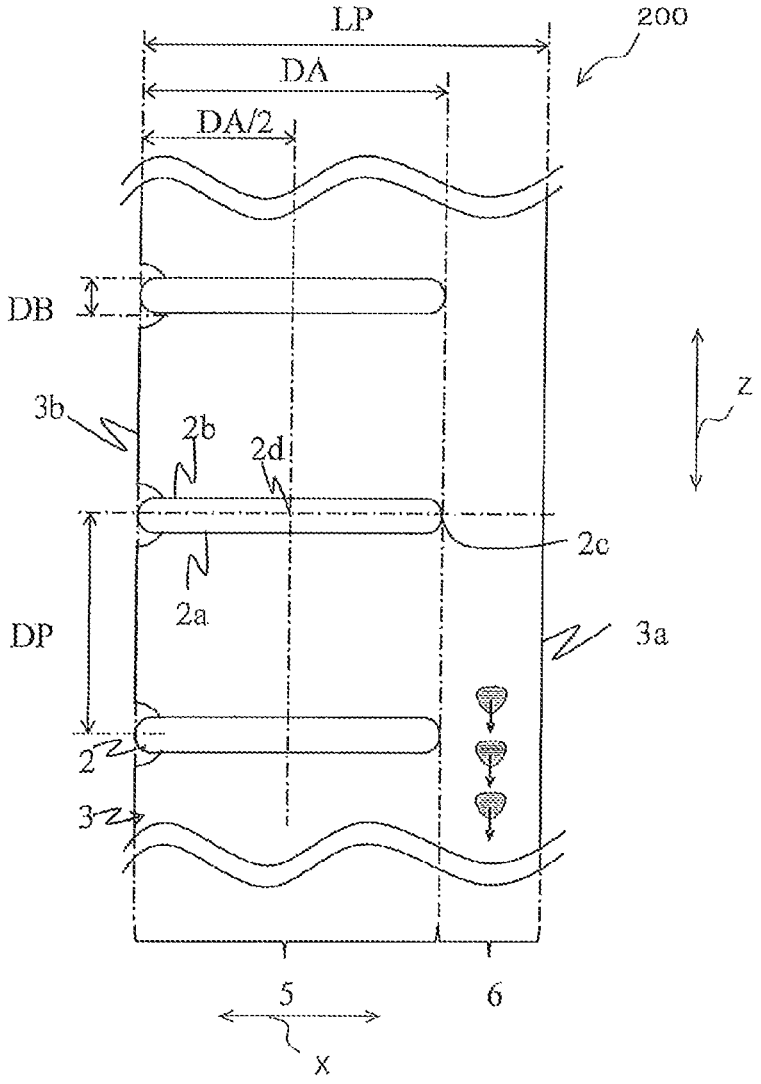
FIG. 6E is a plan view illustrating the operations of the heat exchanger 200 of Comparative Example 1.
Figure 6F:
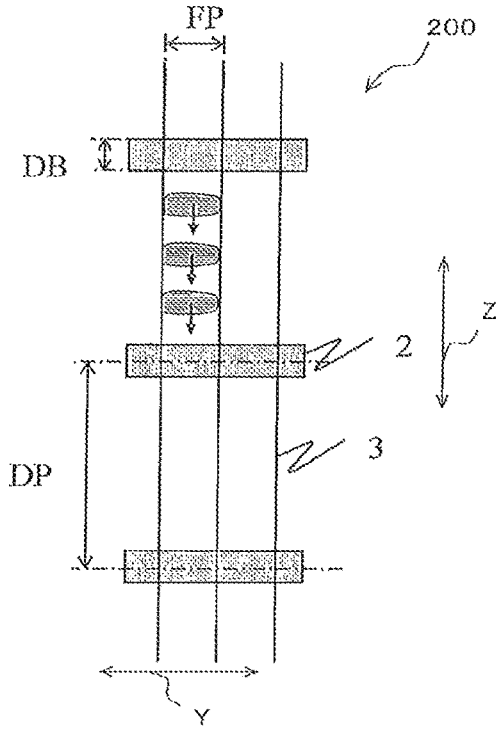
FIG. 6F is a side view illustrating the operations of the heat exchanger 200 of Comparative Example 1.
Figure 6G:
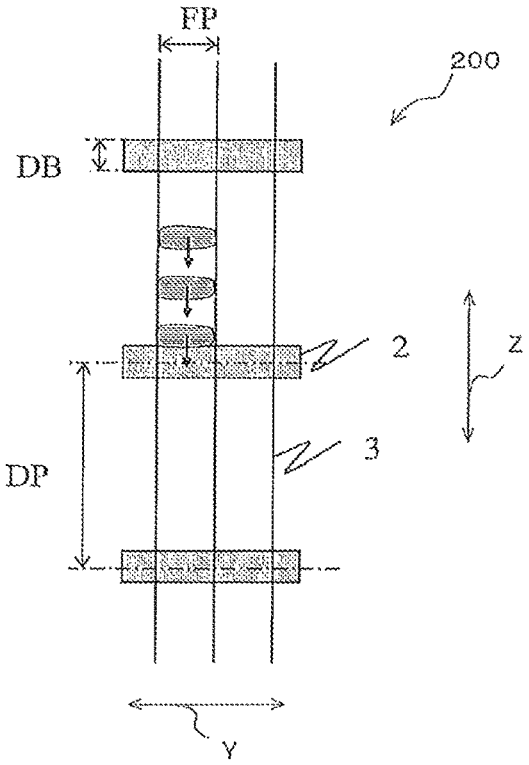
FIG. 6G is a side view illustrating the operations of the heat exchanger 200 of Comparative Example 1.
Figure 6H:
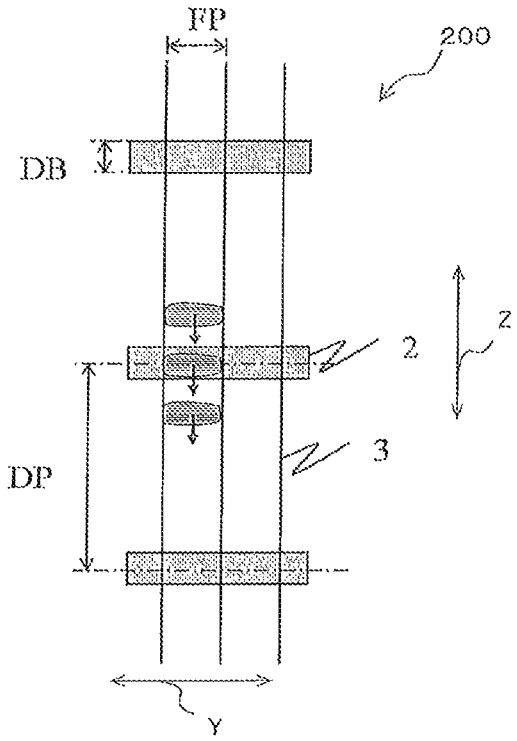
FIG. 6H is a side view illustrating the operations of the heat exchanger 200 of Comparative Example 1.
Figure 6I:
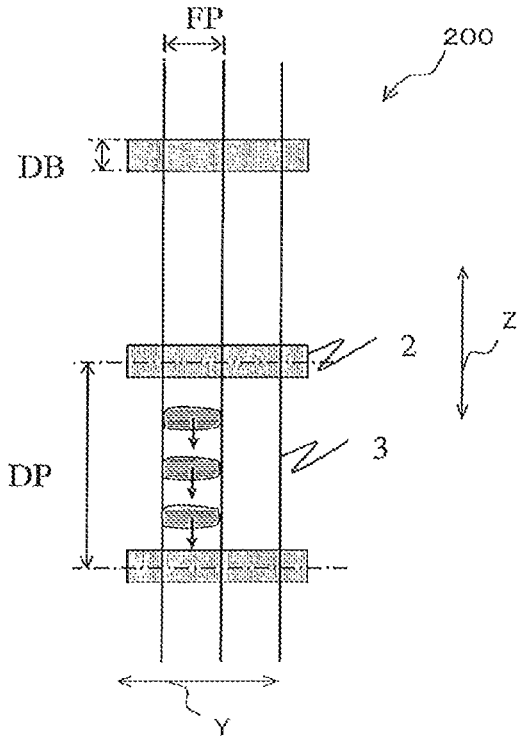
FIG. 6I is a side view illustrating the operations of the heat exchanger 200 of Comparative Example 1.
Figure 6J:
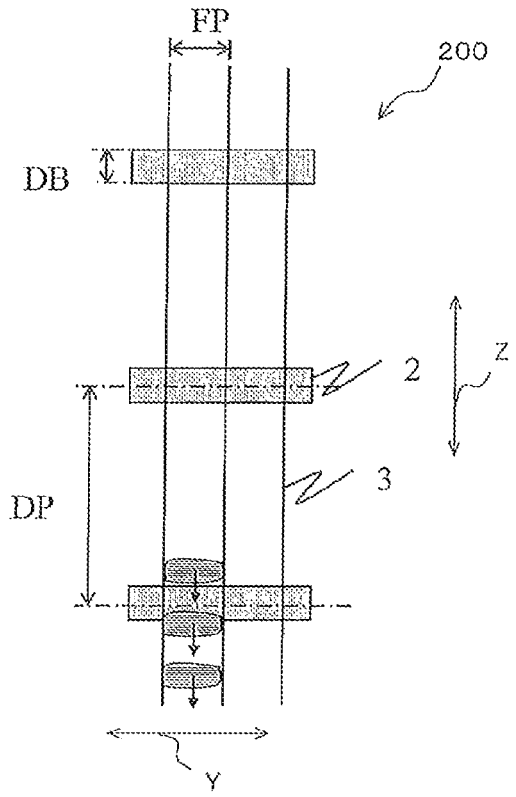
FIG. 6J is a side view illustrating the operations of the heat exchanger 200 of Comparative Example 1.

The water droplet adhering to the drainage region 6 descends along the drainage region 6 (FIG. 6A and FIG. 6F). Then, the descending water droplet is drained to the lower side due to the gravity while maintaining the descending speed because there is no obstacle that may be a resistance to the drainage (FIG. 6B to FIG. 6E and FIG. 6G to FIG. 6J). As described above, as the flat tube 2 that is an obstacle is not present on the lower side, the descent of the water droplet adhering to the drainage region 6 is not hindered by the flat tube 2. As a result, it takes a short period of time to reach the lower end of the heat exchanger 200.

As described above, in the heat exchanger 200 of Comparative Example 1, the water droplet adhering to the cutout region 5 and the water droplet adhering to the drainage region 6 are drained to the lower side of the heat exchanger 200 through different paths. Further, the water droplet adhering to the cutout region 5 requires a long period of time to reach the lower end of the heat exchanger 200. Consequently, in the heat exchanger 200 of Comparative Example 1, it is difficult to reduce the water stagnation amount of the entire heat exchanger 200.

Figure 7:
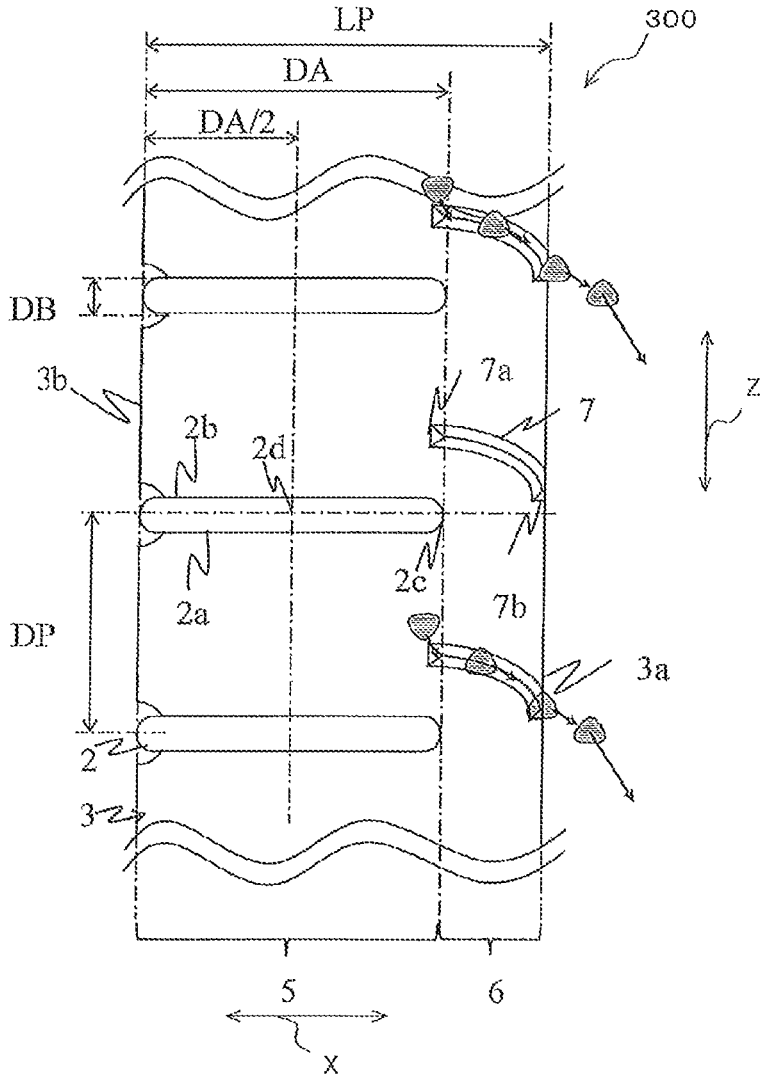
FIG. 7 is a plan view illustrating operations of a heat exchanger 300 of Comparative Example 2.

FIG. 7 is a plan view illustrating operations of a heat exchanger 300 of Comparative Example 2. Next, the operations of the heat exchanger 300 of Comparative Example 2 are described. The heat exchanger 300 of Comparative Example 2 is different from the heat exchanger 1 according to Embodiment 1 in that the other end 7*b* of the protruding portion 7 is located at the other side portion (second edge 3*a*) of the fin 3.

As illustrated in FIG. 7, in the heat exchanger 300 of Comparative Example 2, a water droplet guided to the protruding portion 7 is scattered to the outside of the fin 3 from the other side portion (second edge 3*a*) of the fin 3 due to an inertial force. When the heat exchanger 300 of Comparative Example 2 is mounted in a housing of an air-conditioning apparatus, the water droplet is scattered to the outside of the housing. As a result, the reliability of the air-conditioning apparatus may be decreased.

FIG. 8A to FIG. 8E are plan views illustrating the operations of the heat exchanger 1 according to Embodiment 1 of the present invention, and FIG. 8F to FIG. 8J are side views illustrating the operations of the heat exchanger 1 according to Embodiment 1 of the present invention. Next, the operations of the heat exchanger 1 according to Embodiment 1 are described.

Figure 8A:
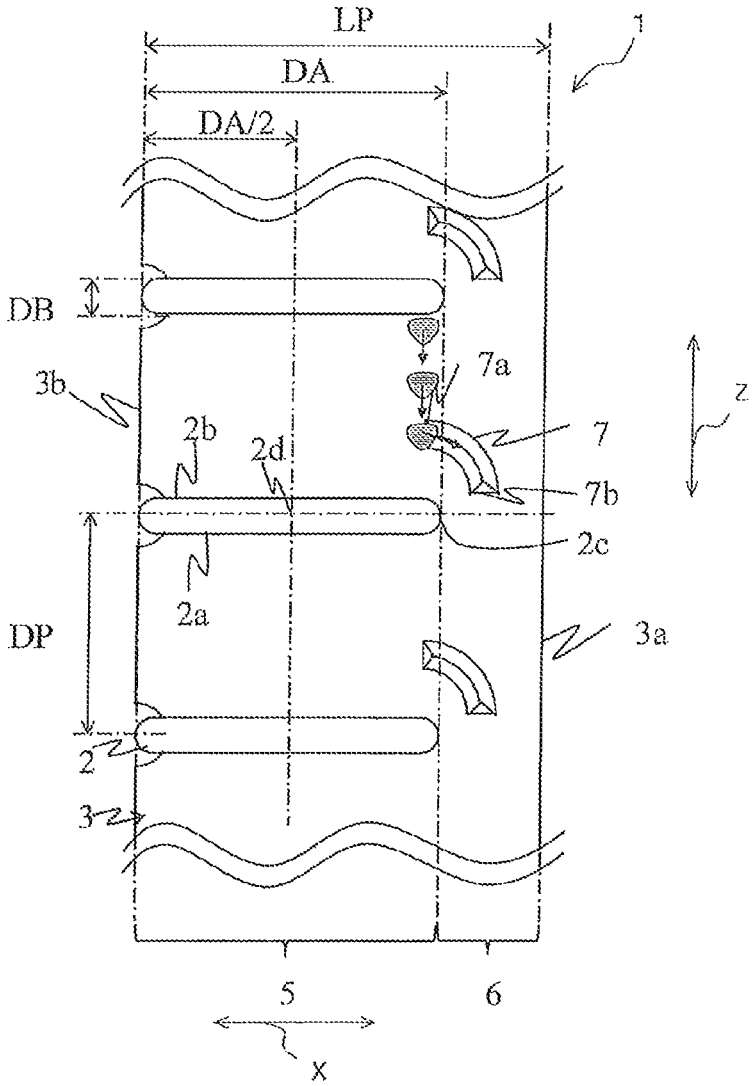
FIG. 8A is a plan view illustrating operations of the heat exchanger 1 according to Embodiment 1 of the present invention.
Figure 8B:
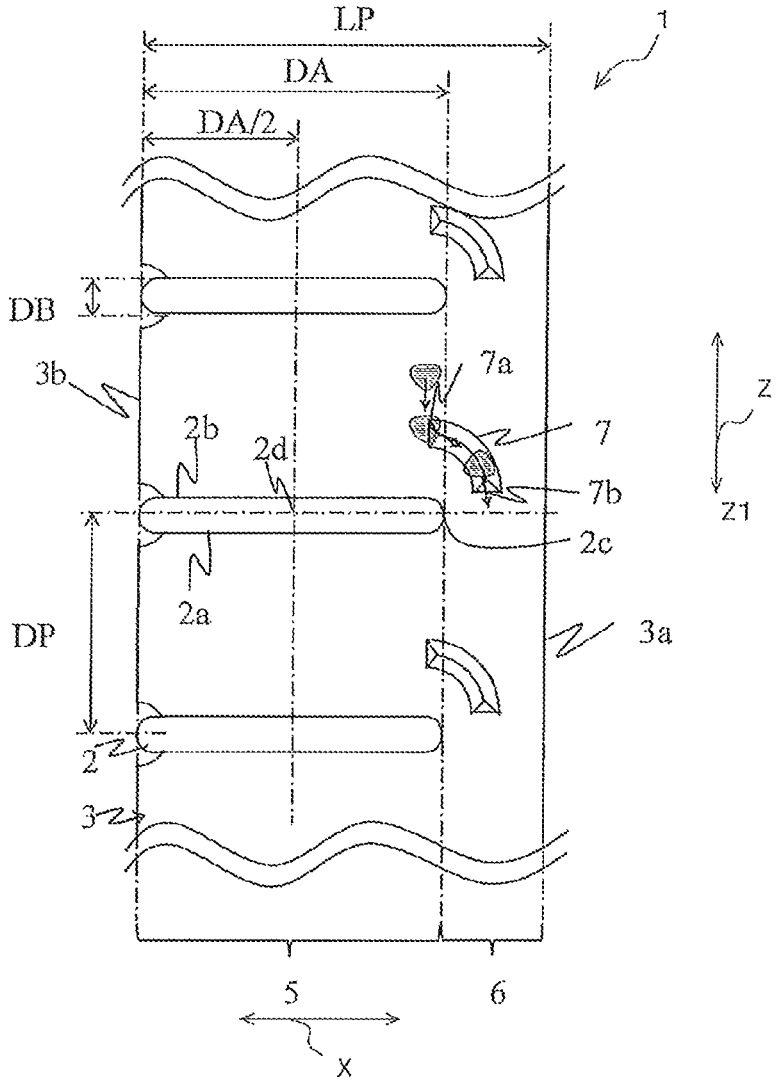
FIG. 8B is a plan view illustrating the operations of the heat exchanger 1 according to Embodiment 1 of the present invention.
Figure 8C:
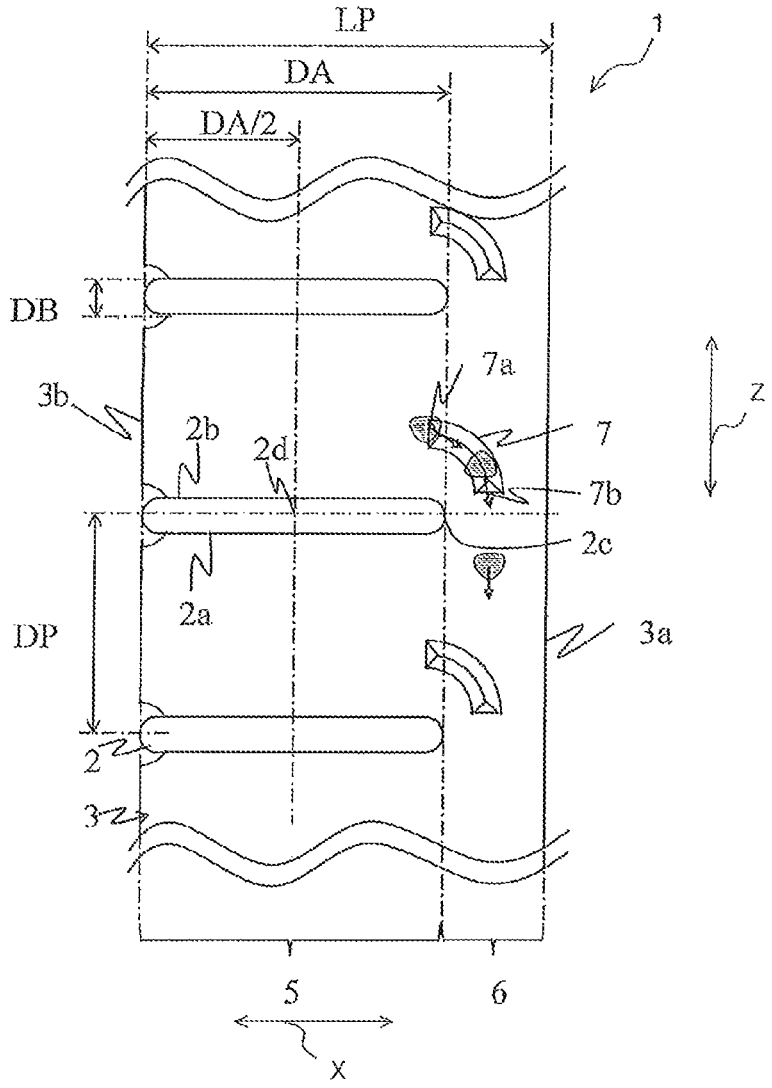
FIG. 8C is a plan view illustrating the operations of the heat exchanger 1 according to Embodiment 1 of the present invention.

A water droplet adhering to the cutout region 5 of the fin 3 descends along the cutout region 5 and reaches the one end 7*a* of the protruding portion 7. The water droplet is captured by the protruding portion 7 due to a capillary force (FIG. 8A and FIG. 8F). This is because the one end 7*a* of the protruding portion 7 is formed in the cutout region 5. Then, the captured water droplet runs along the protruding portion 7 due to the capillary force and the gravity and is guided to the drainage region 6 from the cutout region 5 (FIG. 8B and FIG. 8G), This is because the other end 7*b* of the protruding portion 7 is formed in the drainage region 6. The water droplet guided to the drainage region 6 reaches the other end 7*b*. This is because the other end 7*b* of the protruding portion 7 is formed below the one end 7*a* in the gravity direction (arrow Z1 direction), Then, the water droplet falls onto the drainage region 6 from the other end 7*b* (FIG. 8C and FIG. 8H).

Figure 8D:
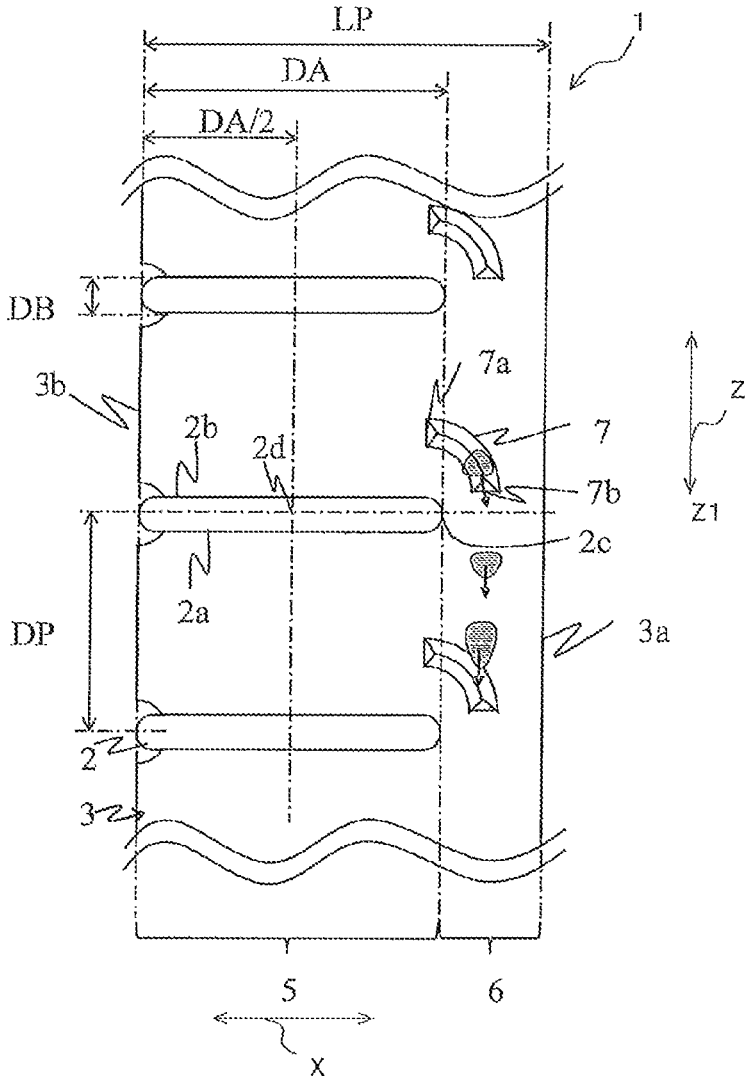
FIG. 8D is a plan view illustrating the operations of the heat exchanger 1 according to Embodiment 1 of the present invention.
Figure 8E:
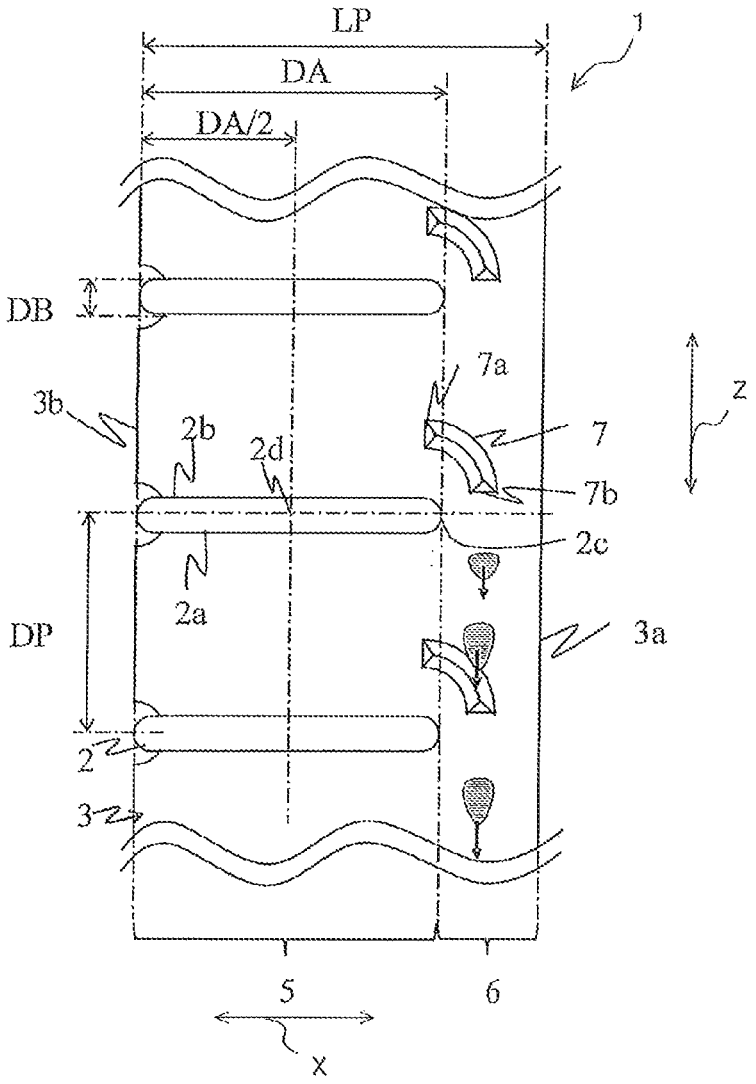
FIG. 8E is a plan view illustrating the operations of the heat exchanger 1 according to Embodiment 1 of the present invention.
Figure 8F:
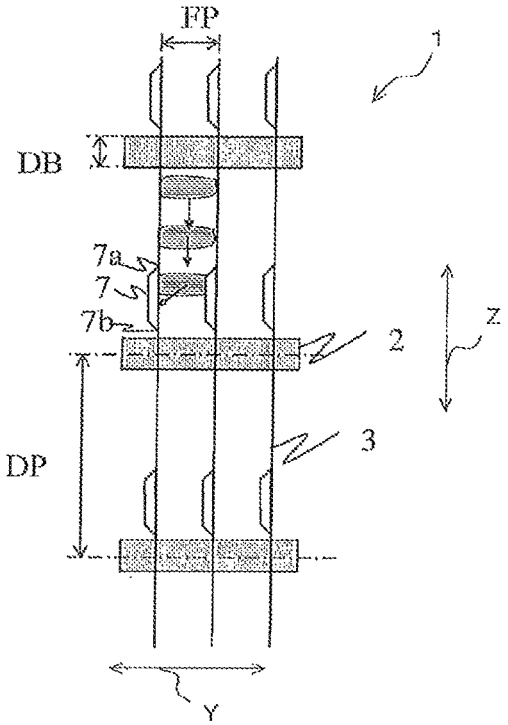
FIG. 8F is a side view illustrating the operations of the heat exchanger 1 according to Embodiment 1 of the present invention.
Figure 8G:
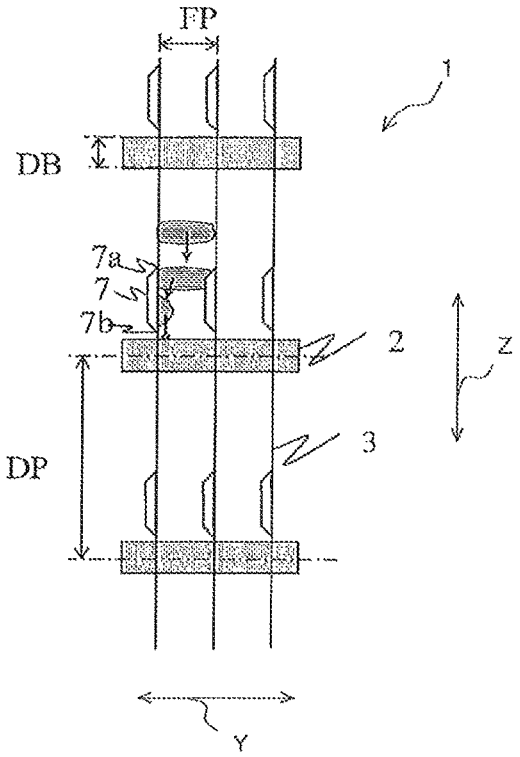
FIG. 8G is a side view illustrating the operations of the heat exchanger 1 according to Embodiment 1 of the present invention.
Figure 8H:
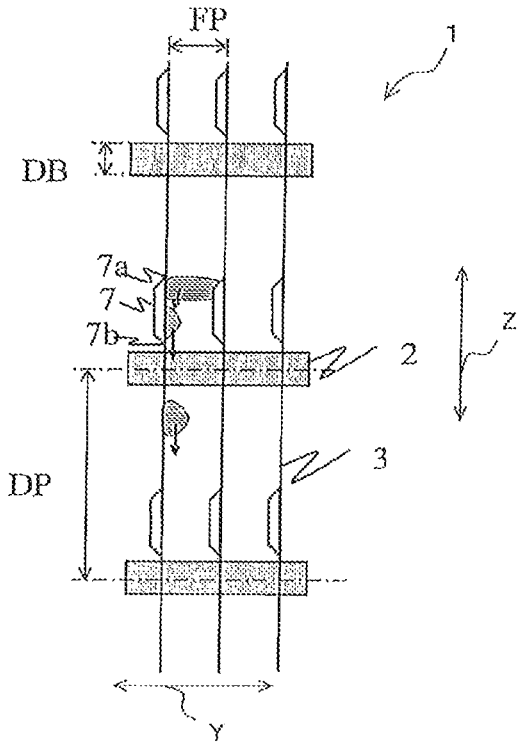
FIG. 8H is a side view illustrating the operations of the heat exchanger 1 according to Embodiment 1 of the present invention.
Figure 8I:
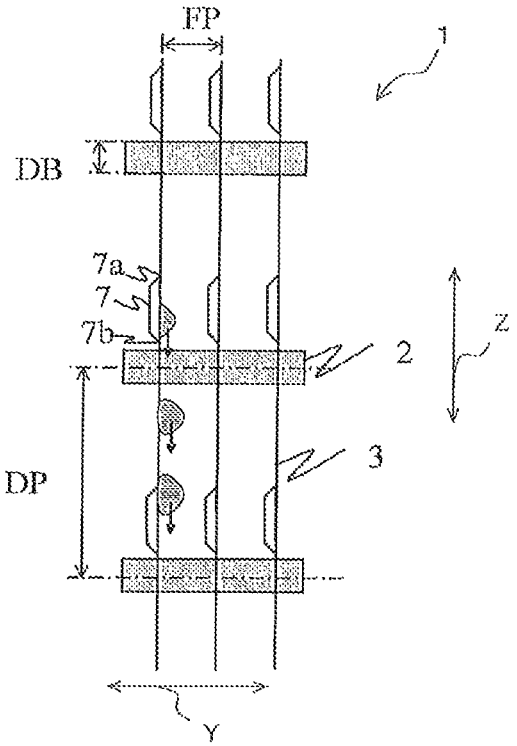
FIG. 8I is a side view illustrating the operations of the heat exchanger 1 according to Embodiment 1 of the present invention.
Figure 8J:
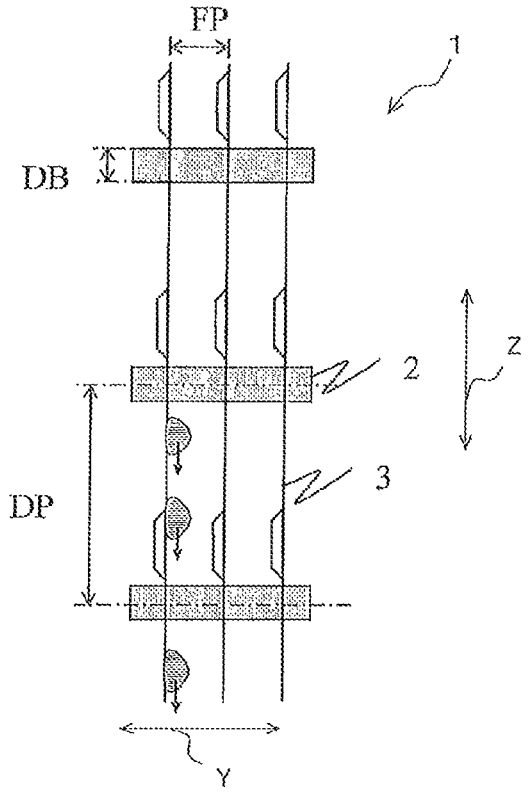
FIG. 8J is a side view illustrating the operations of the heat exchanger 1 according to Embodiment 1 of the present invention.

The water droplet that has fallen onto the drainage region 6 descends due to the gravity while maintaining the descending speed because there is no obstacle that may be a resistance to the drainage (FIG. 8D and FIG. 8I). Note that, even when the water droplet that has fallen onto the drainage region 6 has reached the lower protruding portion 7, the water droplet still continues to descend along the drainage region 6 (FIG. 8E and FIG. 8J). This is because all of the plurality of adjacent protruding portions 7 have the one end 7*a* formed in the cutout region 5 and the other end 7*b* formed in the drainage region 6 below the one end 7*a* in the gravity direction (arrow Z1 direction) and on the inner side with respect to the other side portion (second edge 3*a*) of the fin 3. That is, once the water droplet is guided to the drainage region 6, the water droplet does not return to the cutout region 5. Then, the water droplet is drained to the lower side.

As described above, in the heat exchanger 1 according to Embodiment 1, the protruding portion 7 has the shape in which the one end 7*a* is located in the cutout region 5 and the other end 7*b* is located in the drainage region 6 and is also located below the one end 7*a* (arrow Z1 direction). Therefore, the water droplet adhering to the cutout region 5 is captured by the protruding portion 7 before adhering to the upper surface 2*b* of the flat tube 2, and is guided to the drainage region 6 by the protruding portion 7. Thus, the water droplet does not stagnate on the flat tube 2 and the decrease in the descending speed of the water droplet can be suppressed. Accordingly, it is easy to reduce the water stagnation amount of the entire heat exchanger 1. Further, the other end 7*b* is located in the drainage region 6 and therefore the water droplet running along the protruding portion 7 is prevented from being scattered to the outside of the fin 3. Moreover, the other end 7*b* is formed on the inner side with respect to the other side portion (second edge 3*a*) of the fin 3. Therefore, the water droplet running along the protruding portion 7 is further prevented from being scattered to the outside of the fin 3. Thus, when the heat exchanger 1 is mounted in a housing of an air-conditioning apparatus, the water droplet is prevented from being scattered to the outside of the housing. As a result, the reliability of the air-conditioning apparatus is not decreased. In this manner, the water adhering to the fin 3 is guided to the drainage region 6 by the protruding portion 7. Thus, the drainage performance for water droplets adhering to the fin 3 can be improved while securing reliability.

Moreover, all of the plurality of adjacent protruding portions 7 have the one end 7*a* formed in the cutout region 5 and the other end 7*b* formed in the drainage region 6. The other end 7*b* is formed below the one end 7*a* (arrow Z1 direction) and on the inner side with respect to the other side portion (second edge 3*a*) of the fin 3. Therefore, once the water droplet is guided to the drainage region 6, the water droplet does not return to the cutout region 5. Thus, the water droplet does not stagnate on the flat tube 2 and the period of time required to reach the lower end of the heat exchanger 1 can be shortened. Accordingly, in the heat exchanger 1 according to Embodiment 1, the drainage performance for water droplets adhering to the fin 3 can be improved.

Further, immediately after frost adhering to the heat exchanger 1 starts to melt by a defrosting operation, a large amount of water droplets are drained from the heat exchanger 1, Consequently, the period of time required for the defrosting operation is short. Thus, the amount of heat required for the defrosting operation can be reduced and the defrosting time can also be reduced. Further, water remaining during a heating operation is reduced. Thus, it is possible to achieve improvement in reliability, reduction in airflow resistance, and improvement in resistance to frost formation.

Further, the protruding portion 7 is formed into a smooth shape. That is, the locus of the protruding portion 7 from the one end 7*a* to the other end 7*b* monotonously extends downward in the gravity direction (arrow Z1 direction), or in the horizontal direction (arrow X direction) and downward in the gravity direction (arrow Z1 direction). Thus, the water droplet captured by the protruding portion 7 is smoothly guided to the drainage region 6 while running without hindrance.

Moreover, the protruding portion 7 is formed into an arc shape. Thus, the water droplet captured by the protruding portion 7 is guided to the drainage region 6 more smoothly.

First Modified Example

Figure 9:
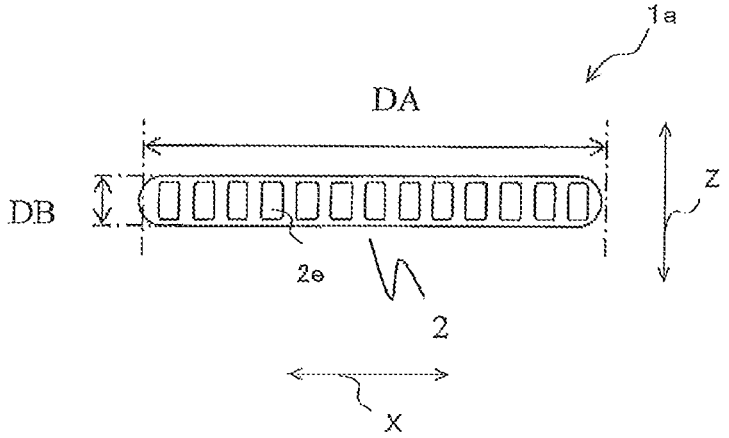
FIG. 9 is a sectional plan view illustrating a flat tube 2 in a first modified example of Embodiment 1 of the present invention.

FIG. 9 is a sectional plan view illustrating a flat tube 2 in a first modified example of Embodiment 1 of the present invention. As illustrated in FIG. 9, in the first modified example, a plurality of refrigerant passages 2*e* are formed inside the flat tube 2 of a heat exchanger 1*a* along a longitudinal direction (arrow X direction). By forming the plurality of refrigerant passages 2*e* inside the flat tube 2 in this manner, the area of contact between the inner surface of the flat tube 2 and the refrigerant is increased. Thus, the heat exchange efficiency is improved.

Second Modified Example

Figure 10:
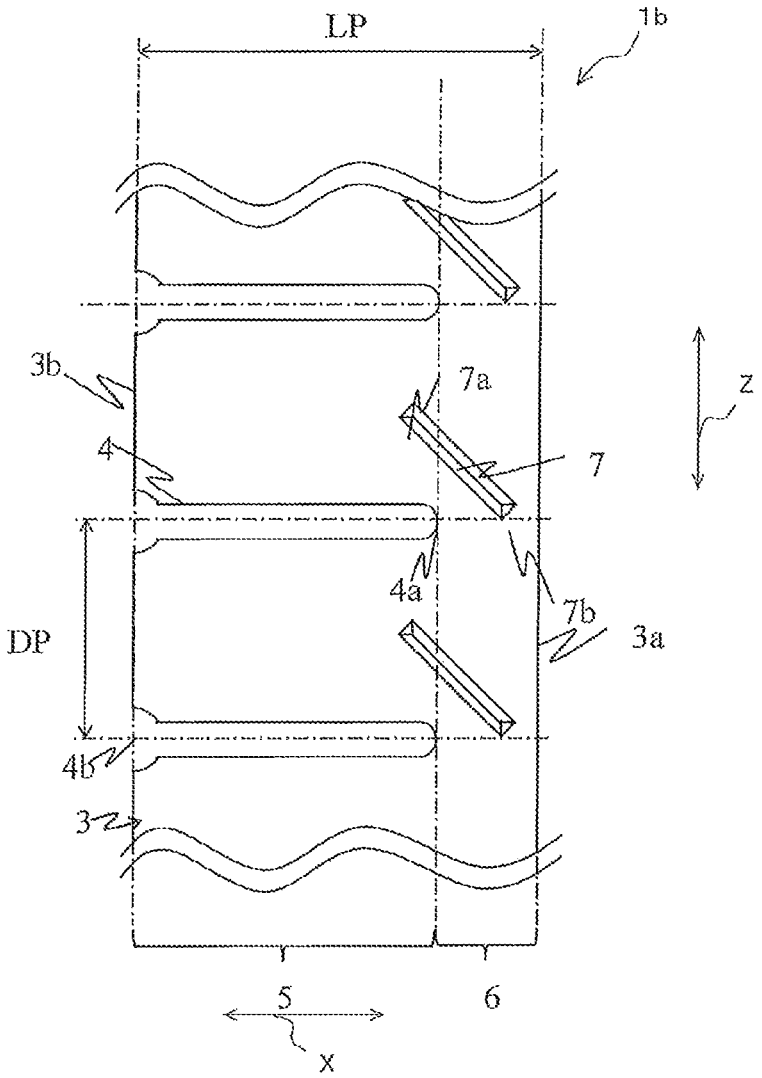
FIG. 10 is a plan view illustrating a heat exchanger 1*b* according to a second modified example of Embodiment 1 of the present invention.

FIG. 10 is a plan view illustrating a heat exchanger 1*b* according to a second modified example of Embodiment 1 of the present invention. As illustrated in FIG. 10, in the second modified example, the protruding portion 7 provided on the fin 3 is formed linearly from the one end 7*a* to the other end 7*b*. That is, the protruding portion 7 is inclined at a predetermined angle with respect to a longitudinal direction (arrow X direction) of the cutout portion 4. Also in the second modified example, advantages similar to those of Embodiment 1 are attained.

Third Modified Example

Figure 11:
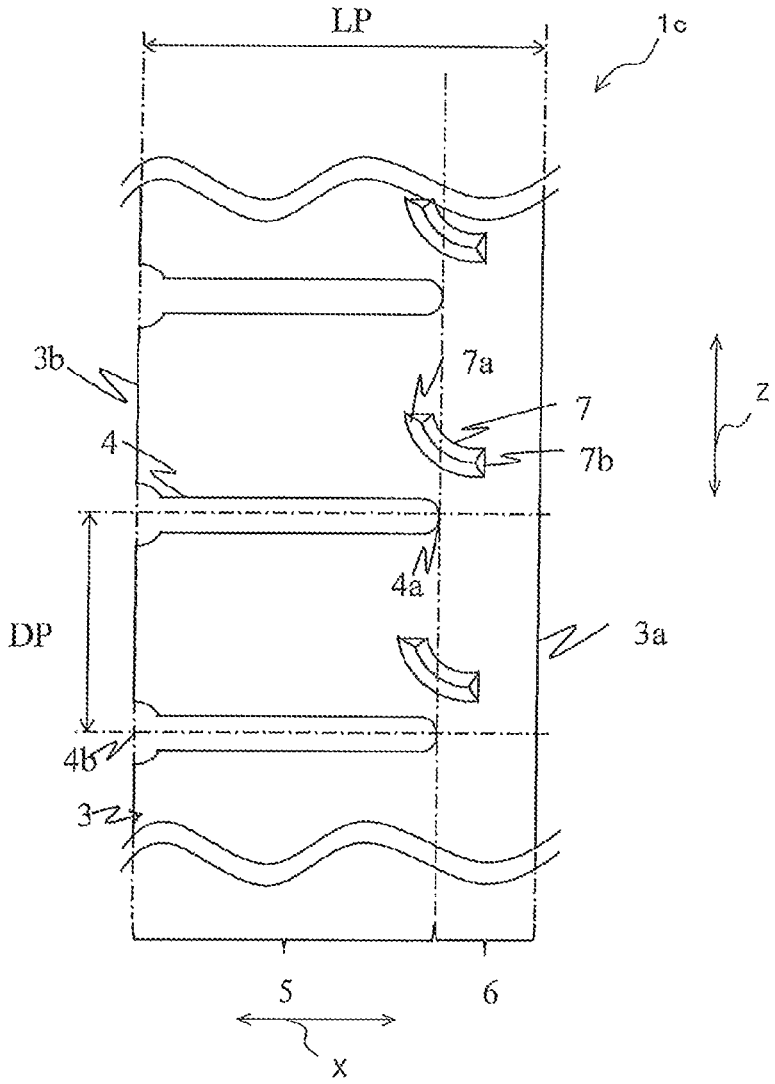
FIG. 11 is a plan view illustrating a heat exchanger 1*c* according to a third modified example of Embodiment 1 of the present invention.

FIG. 11 is a plan view illustrating a heat exchanger 1*c* according to a third modified example of Embodiment 1 of the present invention. As illustrated in FIG. 11, in the third modified example, the center point of the arc of the protruding portion 7 provided on the fin 3 is located on the drainage region 6 side with respect to the one end 7*a*. Also in the third modified example, advantages similar to those of Embodiment 1 are attained.

Fourth Modified Example

Figure 12:
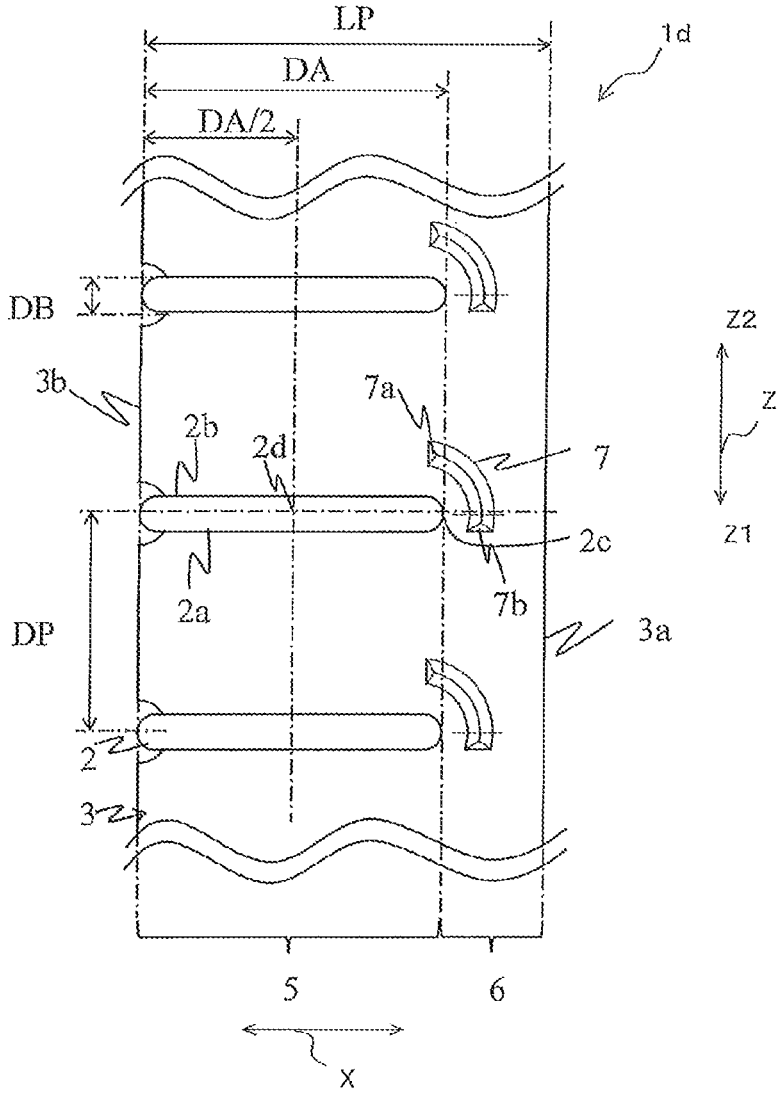
FIG. 12 is a plan view illustrating a heat exchanger 1*d* according to a fourth modified example of Embodiment 1 of the present invention.

FIG. 12 is a plan view illustrating a heat exchanger 1*d* according to a fourth modified example of Embodiment 1 of the present invention. As illustrated in FIG. 12, in the fourth modified example, in the protruding portion 7 provided on the fin 3, the one end 7*a* is formed above the center of the flat tube 2 (in arrow Z2 direction) in the longitudinal direction of the fin 3 and the other end 7*b* is formed below the center of the flat tube 2 (in arrow Z1 direction) in the longitudinal direction of the fin 3. That is, the protruding portion 7 covers the deep portion 4*a* of the cutout portion 4. At this time, the center point of the arc of the protruding portion 7 is located on the cutout region 5 side with respect to the other end 7*b*. Thus, it is possible to reduce stress concentration on the deep portion 4*a* of the cutout portion 4 that is caused when a vertical load is applied to the fin 3. Thus, it is possible to reduce the occurrence of undesired inclination of the fin that may be caused when the heat exchanger 1*d* is formed by bending.

Fifth Modified Example

Figure 13:
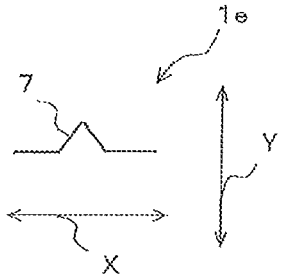
FIG. 13 is a sectional view illustrating a heat exchanger 1*e* according to a fifth modified example of Embodiment 1 of the present invention.

FIG. 13 is a sectional view illustrating a heat exchanger 1*e* according to a fifth modified example of Embodiment 1 of the present invention. The sectional shape of the protruding portion 7 is not limited as long as the protruding portion 7 has a structure in which a capillary force is generated, water droplets are easily drawn in, and a large amount of water droplets can be guided to the drainage region 6. As illustrated in FIG. 13, in the fifth modified example, the sectional shape of the protruding portion 7 provided on the fin 3 is an inverted V-shape. Thus, as the protruding portion 7 has a corner portion, an even greater capillary force is generated. Consequently, the drainage rate is further improved.

Sixth Modified Example

Figure 14:
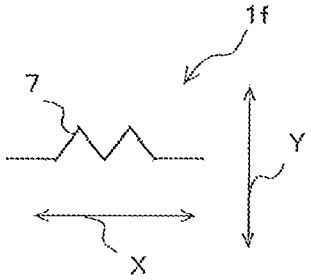
FIG. 14 is a sectional view illustrating a heat exchanger if according to a sixth modified example of Embodiment 1 of the present invention.

FIG. 14 is a sectional view illustrating a heat exchanger 1*f* according to a sixth modified example of Embodiment 1 of the present invention. As illustrated in FIG. 14, in the sixth modified example, the sectional shape of the protruding portion 7 provided on the fin 3 is an inverted W-shape. Thus, as the protruding portion 7 has corner portions, an even greater capillary force is generated. Consequently, the drainage rate is further improved.

Seventh Modified Example

Figure 15:
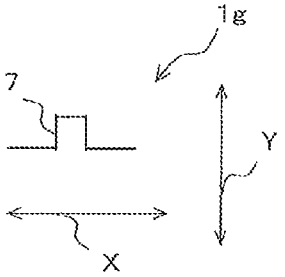
FIG. 15 is a sectional view illustrating a heat exchanger 1*g* according to a seventh modified example of Embodiment 1 of the present invention.

FIG. 15 is a sectional view illustrating a heat exchanger 1*g* according to a seventh modified example of Embodiment 1 of the present invention. As illustrated in FIG. 15, in the seventh modified example, the sectional shape of the protruding portion 7 provided on the fin 3 is a rectangular shape. Thus, as the protruding portion 7 has corner portions, an even greater capillary force is generated. Consequently, the drainage rate is further improved.

Eighth Modified Example

Figure 16:
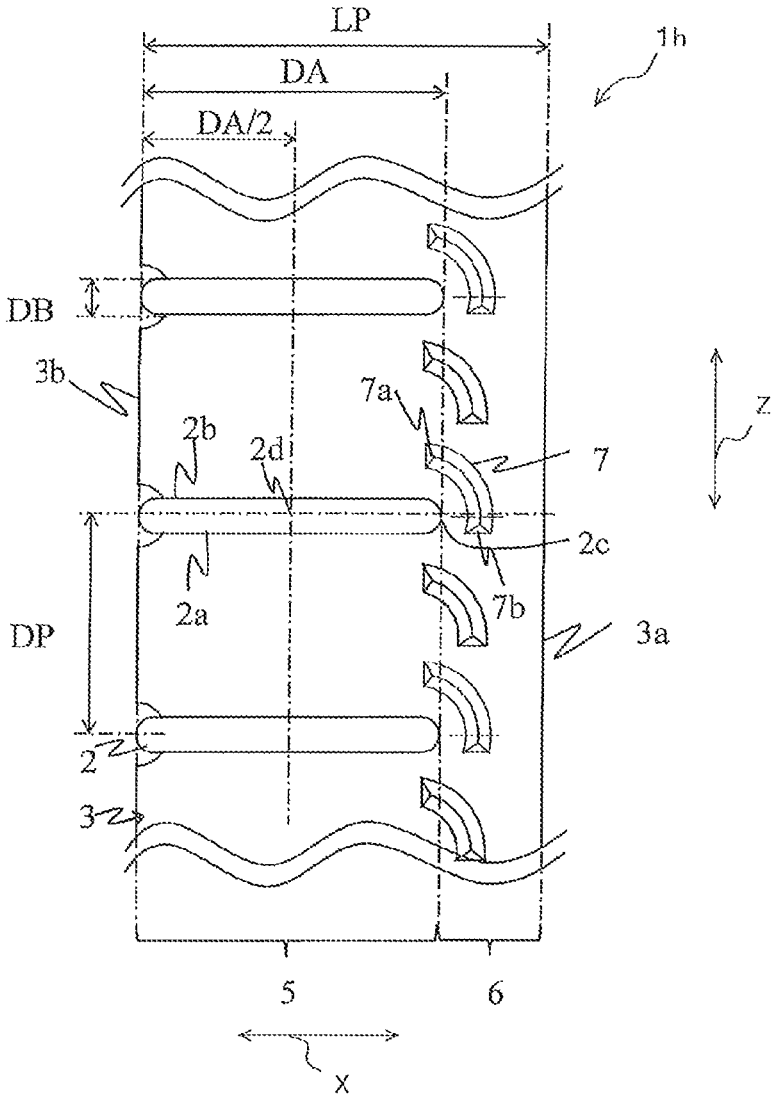
FIG. 16 is a sectional view illustrating a heat exchanger 1*h* according to an eighth modified example of Embodiment 1 of the present invention.

FIG. 16 is a sectional view illustrating a heat exchanger 1*h* according to an eighth modified example of Embodiment 1 of the present invention. As illustrated in FIG. 16, in the eighth modified example, a plurality of protruding portions 7 are provided between adjacent ones of plurality of cutout portions 4. Thus, in the cutout region 5, the number of portions led out to the drainage region 6 is increased. Consequently, the drainage rate is further improved.

Embodiment 2

Figure 17:
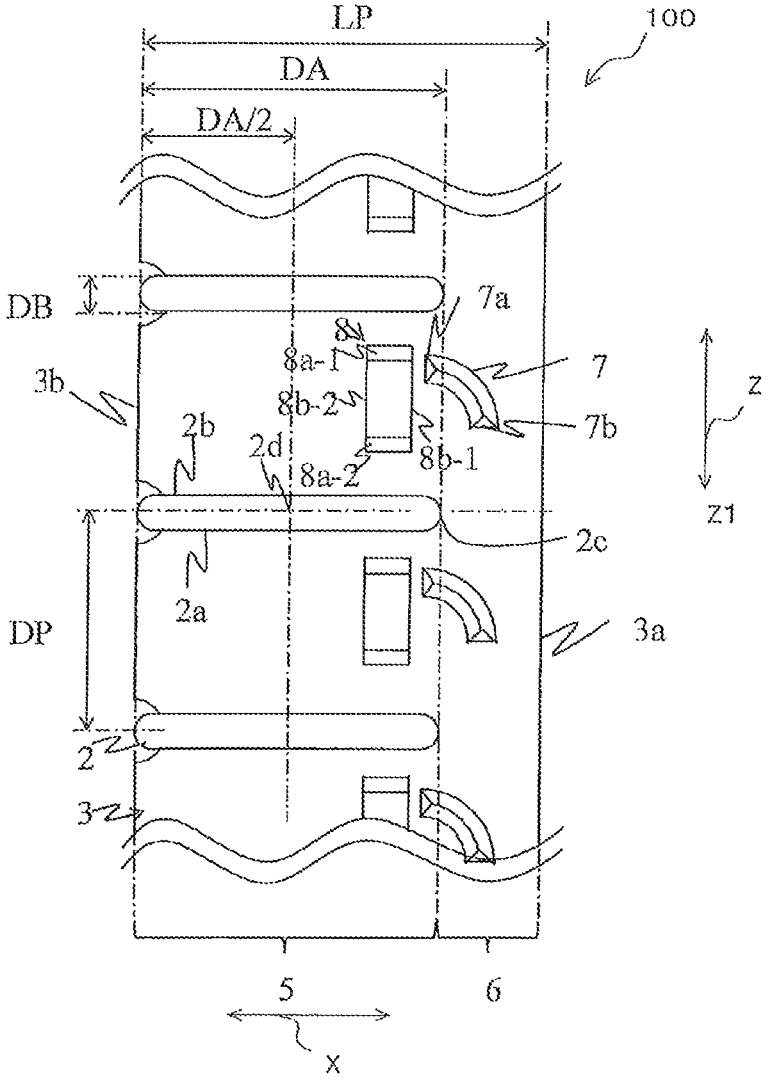
FIG. 17 is a plan view illustrating a heat exchanger 100 according to Embodiment 2 of the present invention.
Figure 18:
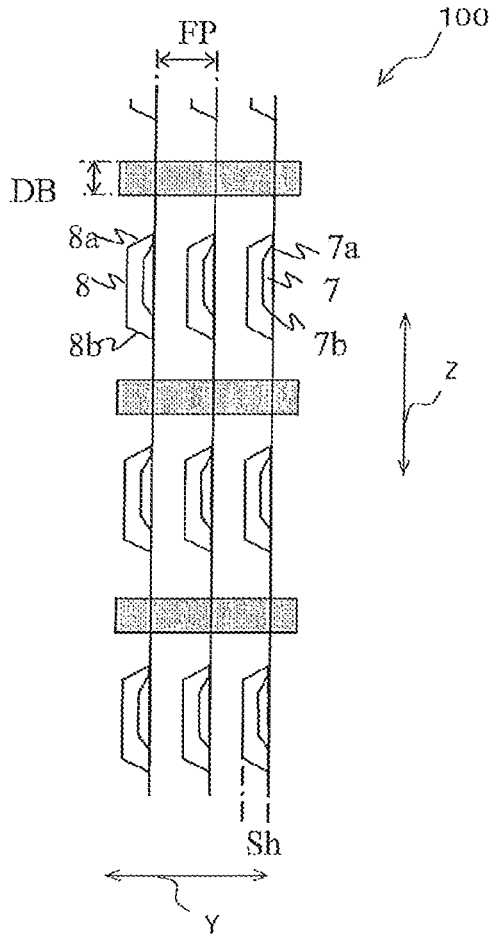
FIG. 18 is a side view illustrating the heat exchanger 100 according to Embodiment 2 of the present invention.
Figure 19:
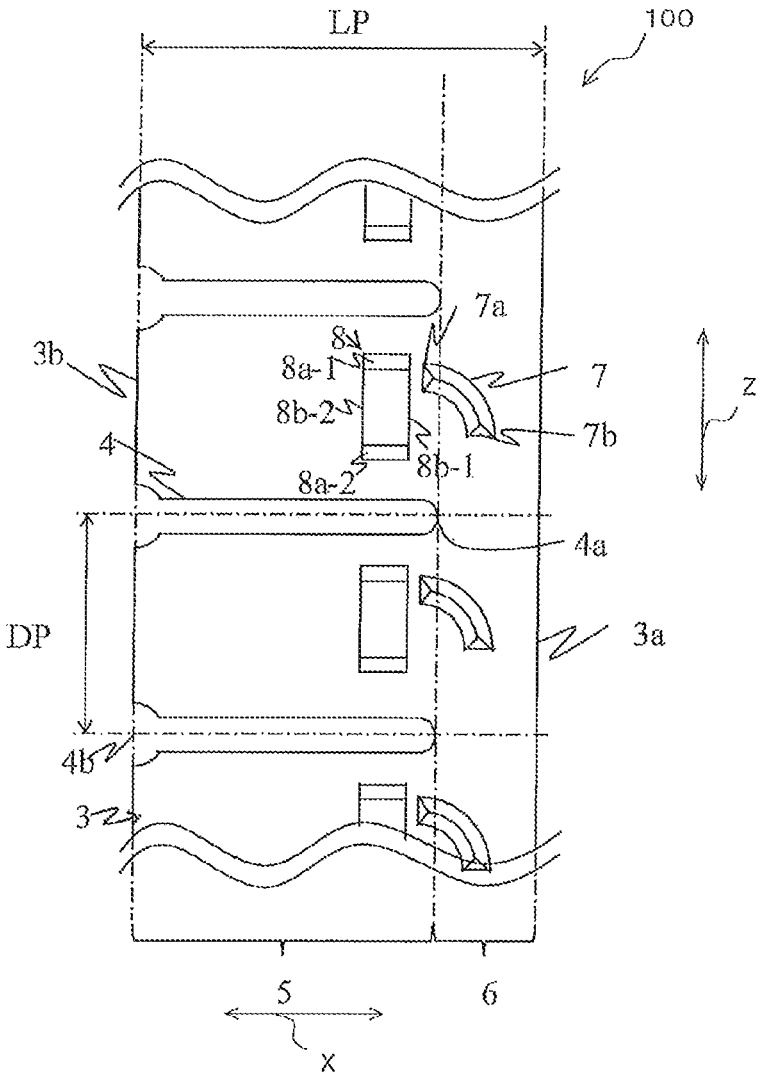
FIG. 19 is a plan view illustrating a fin 3 in Embodiment 2 of the present invention.

FIG. 17 is a plan view illustrating a heat exchanger 100 according to Embodiment 2 of the present invention, and FIG. 18 is a side view illustrating the heat exchanger 100 according to Embodiment 2 of the present invention. Embodiment 2 is different from Embodiment 1 in that cut-and-raised pieces 8 are formed on the fin 3. In Embodiment 2, parts in common with Embodiment 1 are denoted by the same reference signs to omit the descriptions of the parts, and differences from Embodiment 1 are mainly described.

As illustrated in FIG. 17 and FIG. 18, the cut-and-raised piece 8 is formed by cutting and raising a part of the cutout region 5 of the fin 3. The cut-and-raised piece 8 is formed to extend perpendicularly to a transverse direction (arrow X direction) of the fin 3, that is, in the gravity direction (arrow Z direction). The cut-and-raised piece 8 is formed by incising and raising a part of the fin 3.

In this case, a side portion of the cut-and-raised piece 8 on the drainage region 6 side that corresponds to a cutting line is referred to as a first slit cutting portion 8*b*-1 and a side portion of the cut-and-raised piece 8 on the cutout region 5 side that corresponds to a cutting line is referred to as a second slit cutting portion 8*b*-2. Parts of the cut-and-raised piece 8 where the fin 3 is raised are referred to as slit raising portions. An upper slit raising portion is referred to as a first slit raising portion 8*a*-1 and a lower slit raising portion is referred to as a second slit raising portion 8*a*-2. Note that the rising height of the slit in a fin arrangement direction (arrow Y direction) is represented by Sh.

Further, the end of the cut-and-raised piece 8 on the drainage region 6 side, that is, the first slit cutting portion 8*b*-1 is formed on the drainage region 6 side with respect to a center 2*d* of the flat tube 2 in the transverse direction (arrow X direction) of the fin 3. In addition, the one end 7*a* of the protruding portion 7 is formed on the drainage region 6 side with respect to the slit raising portion that is a part of the cut-and-raised piece 8 where the fin 3 is raised. Further, the one end 7*a* of the protruding portion 7 is formed below either one of the two slit raising portions of the cut-and-raised piece 8 in the gravity direction (arrow Z1 direction). In Embodiment 2, the one end 7*a* of the protruding portion 7 is formed below the first slit raising portion 8*a*-1 in the gravity direction (arrow Z1 direction).

The cut-and-raised piece 8 breaks and refreshes a thermal boundary layer developed in an airflow direction. That is, the cut-and-raised piece 8 thins the thermal boundary layer and consequently the resistance caused along with heat transfer is reduced. Thus, the heat transfer is promoted between the fins 3 and air flowing through an airflow passage between the fins 3.

Figure 20A:
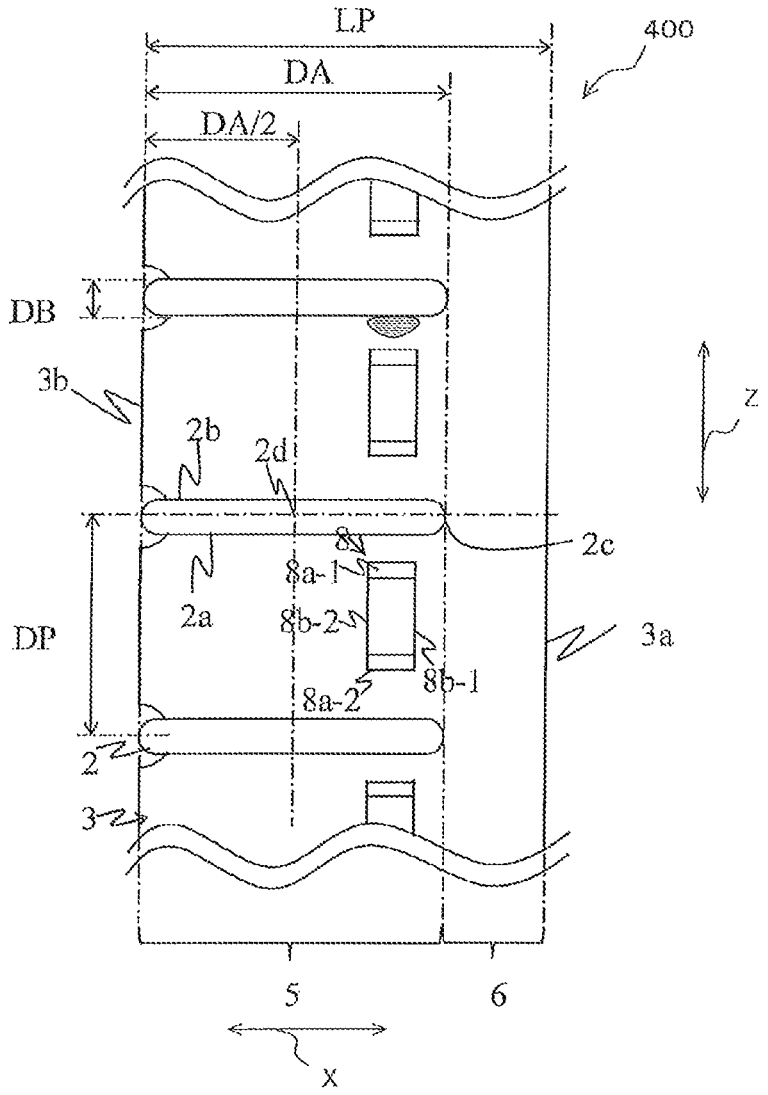
FIG. 20A is a plan view illustrating operations of a heat exchanger 400 of Comparative Example 3.
Figure 20B:
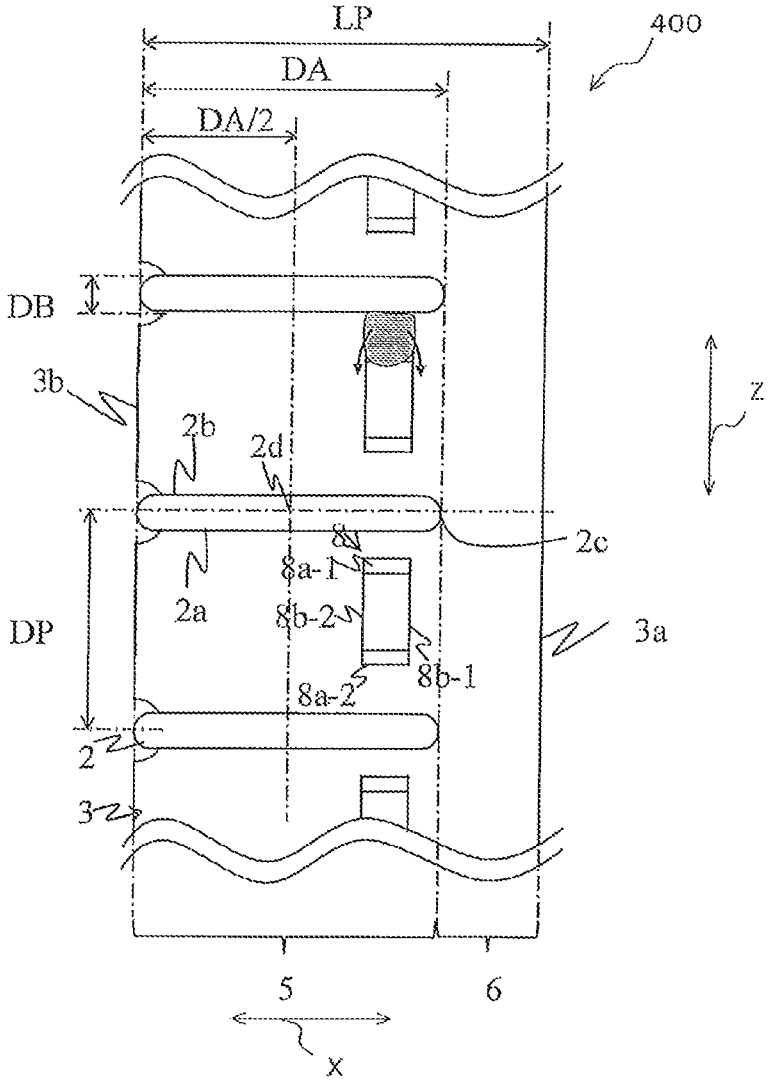
FIG. 20B is a plan view illustrating the operations of the heat exchanger 400 of Comparative Example 3.
Figure 20C:
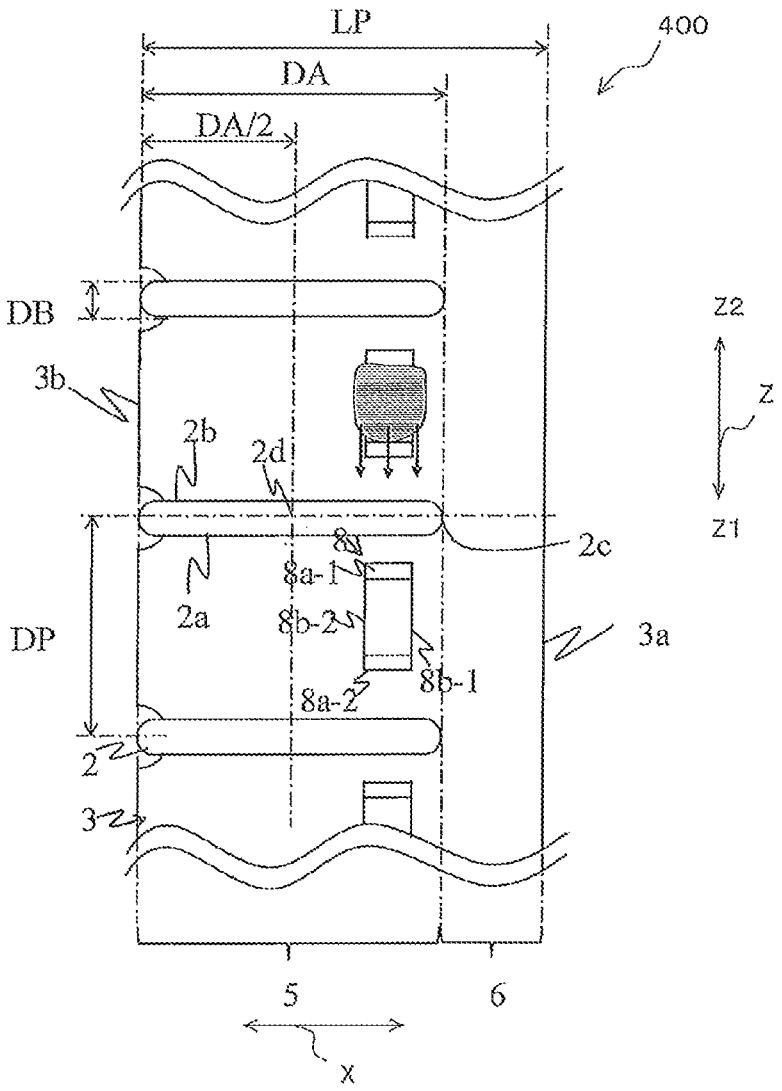
FIG. 20C is a plan view illustrating the operations of the heat exchanger 400 of Comparative Example 3.
Figure 20D:
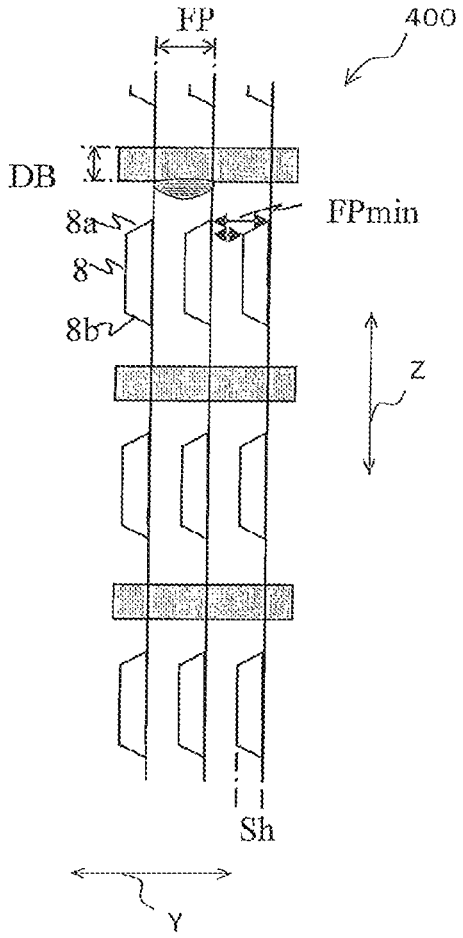
FIG. 20D is a side view illustrating the operations of the heat exchanger 400 of Comparative Example 3.
Figure 20E:
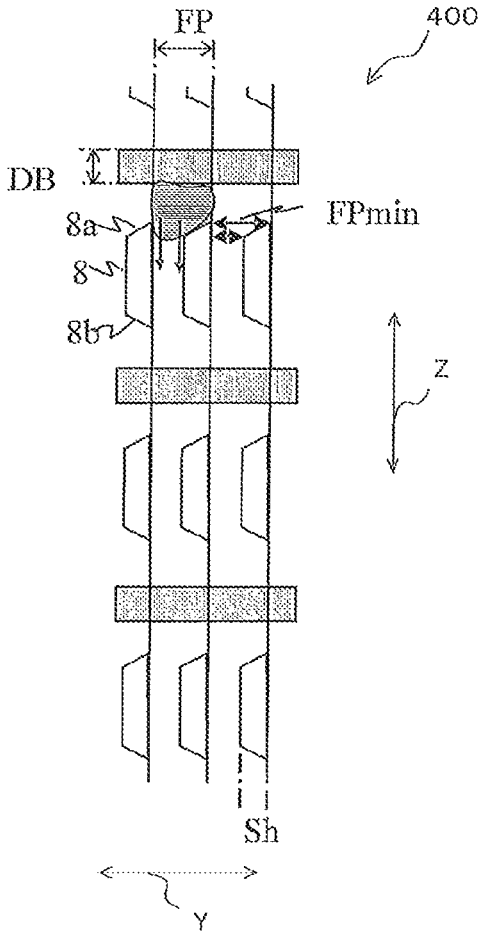
FIG. 20E is a side view illustrating the operations of the heat exchanger 400 of Comparative Example 3.
Figure 20F:
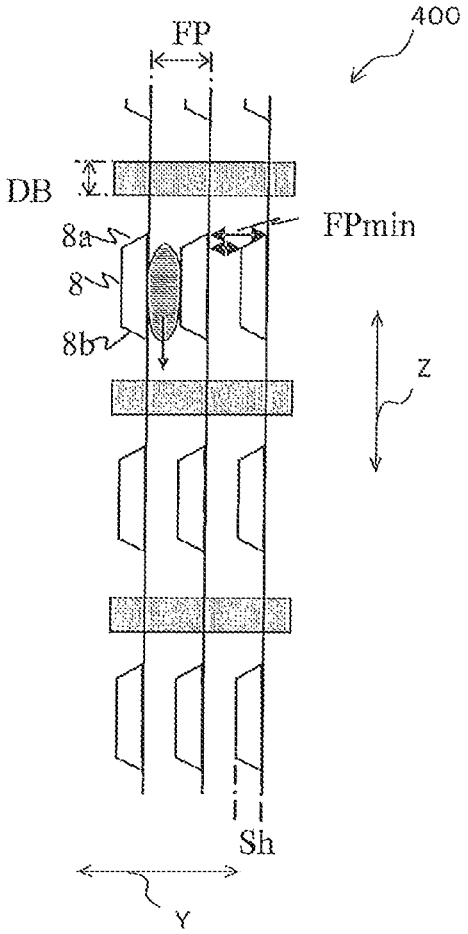
FIG. 20F is a side view illustrating the operations of the heat exchanger 400 of Comparative Example 3.

FIG. 20A to FIG. 20C are plan views illustrating operations of a heat exchanger 400 of Comparative Example 3, and FIG. 20D to FIG. 20F are side views illustrating the operations of the heat exchanger 400 of Comparative Example 3. Next, the operations of the heat exchanger 400 of Comparative Example 3 are described for the description of operations of the heat exchanger 100 according to Embodiment 2. The heat exchanger 400 of Comparative Example 3 is different from the heat exchanger 100 according to Embodiment 2 in that the protruding portions 7 are not provided on the fin 3.

First, a process of draining a water droplet when the amount of the water droplet is large is described. Note that the draining process up to the lower surface 2*a* of the flat tube 2 is similar to that of Comparative Example 1 (FIG. 6A to FIG. 6J). The water droplet stagnating on the lower surface 2*a* of the flat tube 2 (FIG. 20A and FIG. 20D) is brought into contact with a narrow space FPmin (>fin pitch FP) formed between the first slit raising portion 8*a*-1 of the cut-and-raised piece 8 and the bottom surface of the adjacent fin 3 (FIG. 20B and FIG. 20E).

Then, a capillary force acting in a narrow direction is generated in the narrow space FPmin and consequently the water droplet more easily separates from the lower surface 2*a* of the flat tube 2 compared with Comparative Example 1 in which the cut-and-raised pieces 8 are not formed. The water droplet that has separated from the lower surface 2*a* of the flat tube 2 also separates from the narrow space FPmin because the action of the gravity applied to the water droplet itself (in arrow Z1 direction) is greater than that of the capillary force acting upward (in arrow Z2 direction) in the narrow space FPmin between the cut-and-raised piece 8 and the adjacent fin 3 (FIG. 20C and FIG. 20F). As described above, in the heat exchanger 400 of Comparative Example 3, the water droplet is smoothly drained when the amount of the water droplet is relatively large, and consequently the drainage rate is high.

Figure 21A:
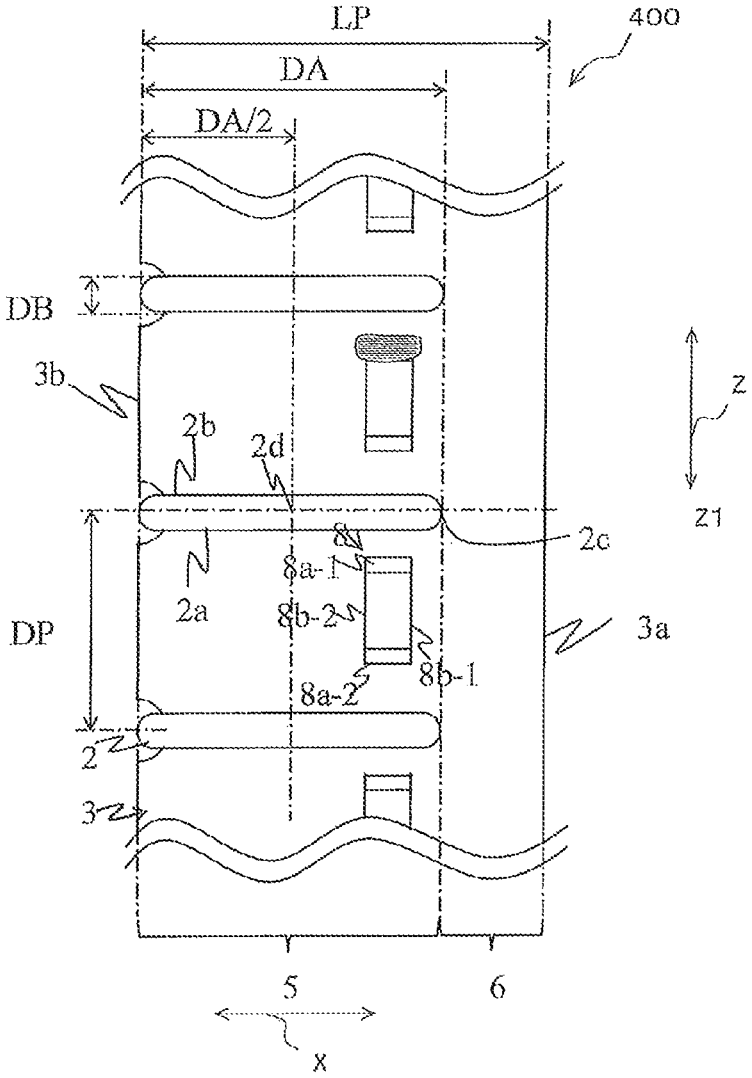
FIG. 21A is a plan view illustrating the operations of the heat exchanger 400 of Comparative Example 3.
Figure 21B:
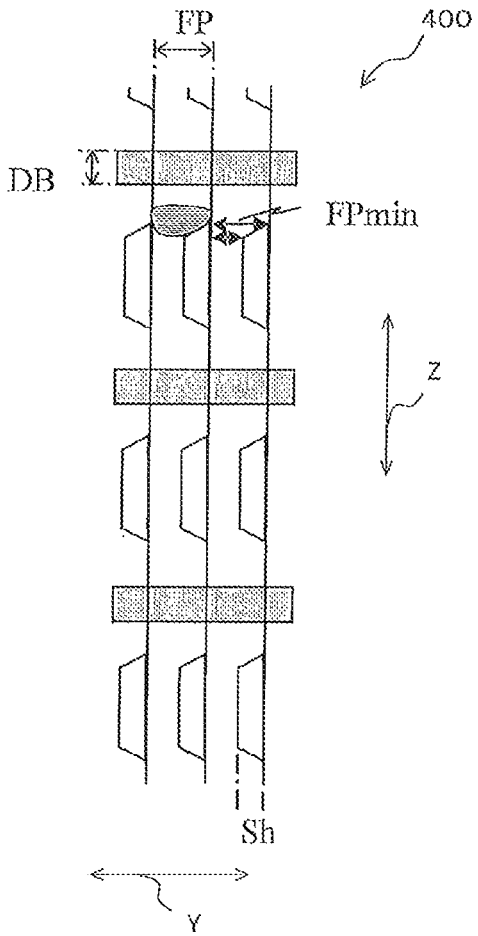
FIG. 21B is a side view illustrating the operations of the heat exchanger 400 of Comparative Example 3.

FIG. 21A is a plan view illustrating the operations of the heat exchanger 400 of Comparative Example 3, and FIG. 21B is a side view illustrating the operations of the heat exchanger 400 of Comparative Example 3. Next, a process of draining a water droplet when the amount of the water droplet is small is described.

As illustrated in FIG. 21A and FIG. 21B, when the amount of the water droplet is small, the gravity applied to the water droplet itself (in arrow Z1 direction) is low. Consequently, the water droplet that has separated from the lower surface 2*a* of the flat tube 2 stagnates in the narrow space FPmin between the cut-and-raised piece 8 and the adjacent fin 3 due to the capillary force. Note that the capillary force is generated by the surface tension and has an action of causing water into contact with as wide a surface as possible. That is, water is caused to spread over the surface. Then, the water droplet stagnates in the narrow space FPmin with the gravity and the capillary force balanced with each other in a state in which a part of the water droplet is located outside the cut-and-raised piece 8 due to the characteristics of the surface tension. As described above, in the heat exchanger 400 of Comparative Example 3, the drainage performance is decreased when the amount of the water droplet is small.

Figure 22A:
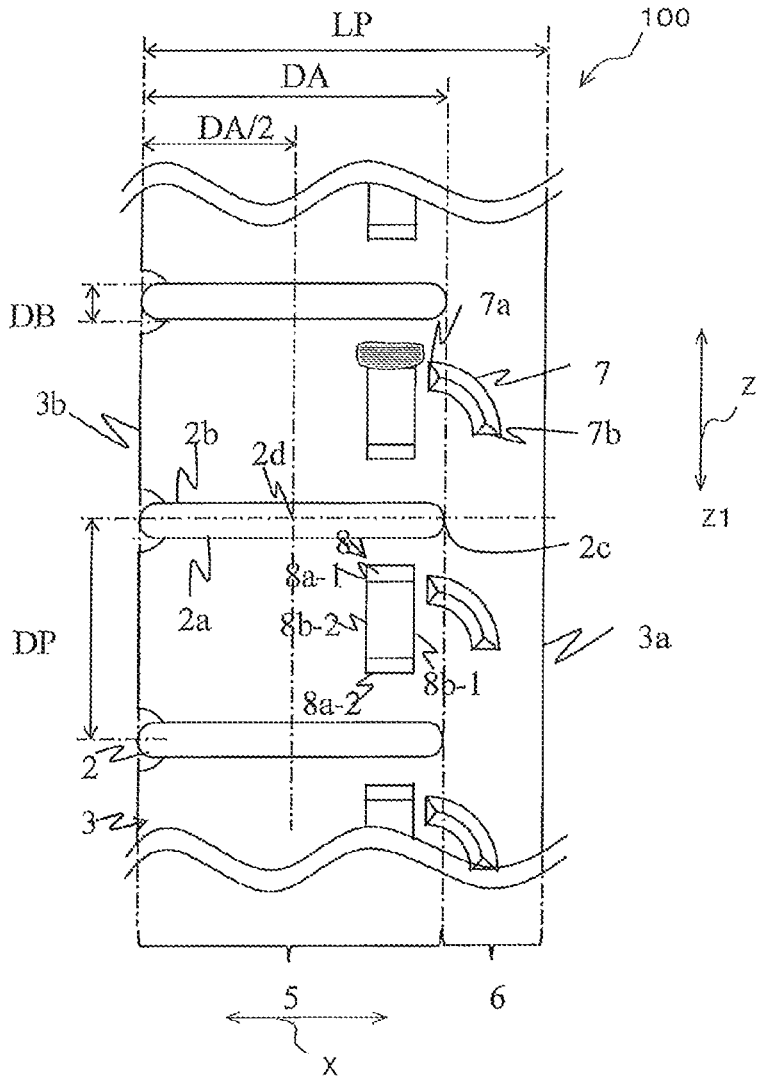
FIG. 22A is a plan view illustrating operations of the heat exchanger 100 according to Embodiment 2.
Figure 22B:
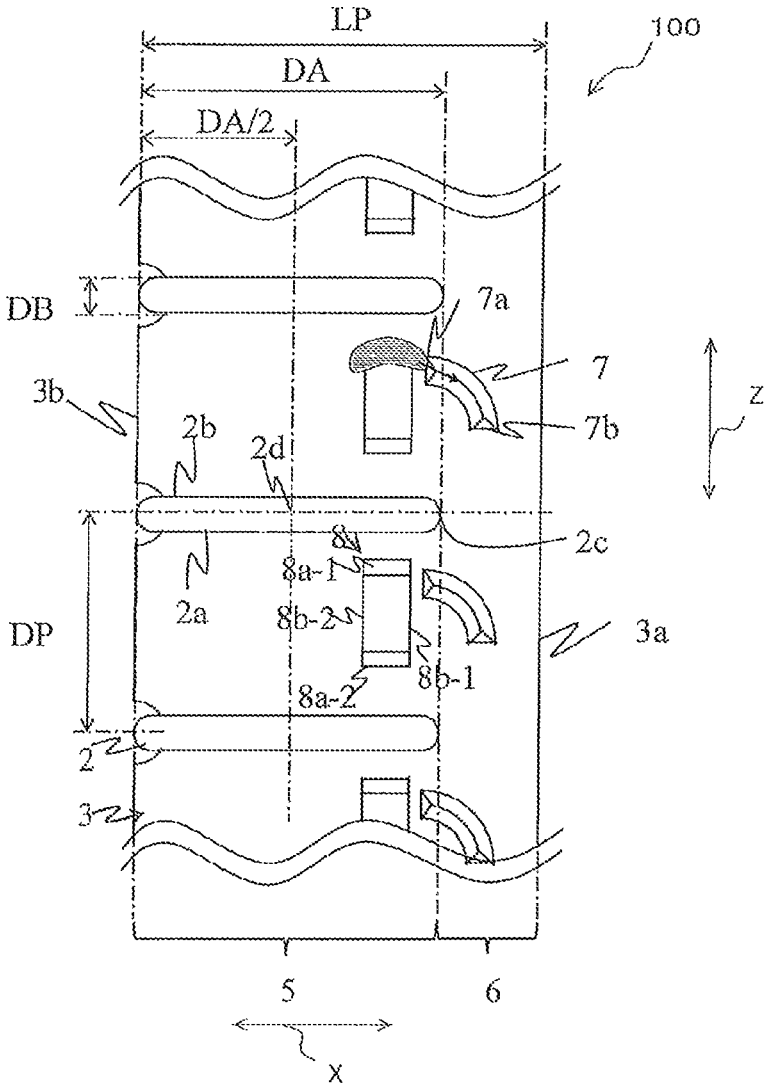
FIG. 22B is a plan view illustrating the operations of the heat exchanger 100 according to Embodiment 2.
Figure 22C:
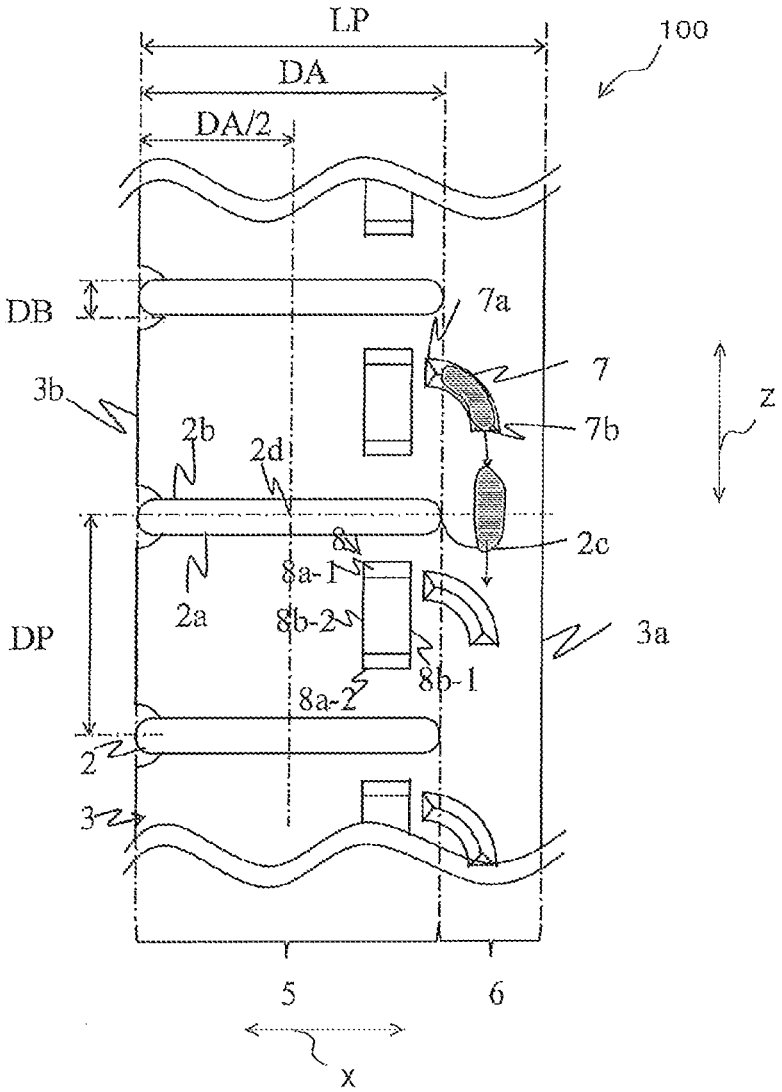
FIG. 22C is a plan view illustrating the operations of the heat exchanger 100 according to Embodiment 2.
Figure 22D:
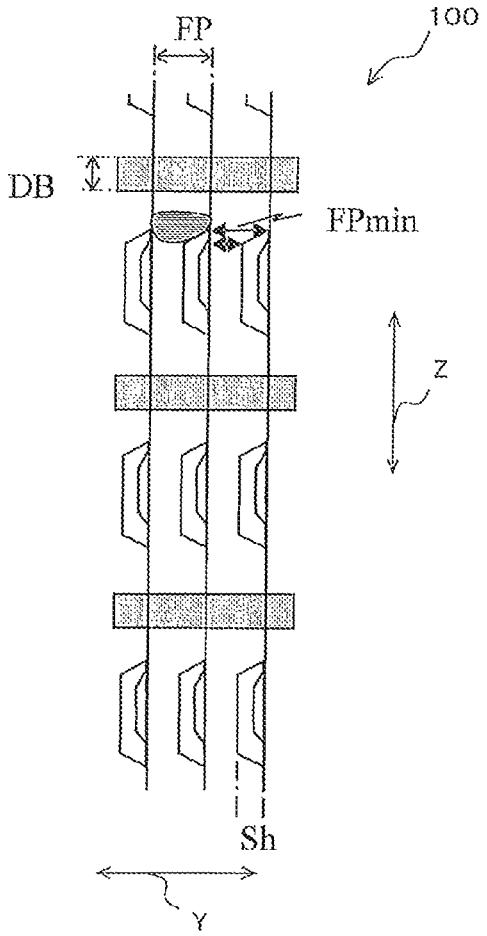
FIG. 22D is a side view illustrating the operations of the heat exchanger 100 according to Embodiment 2.
Figure 22E:
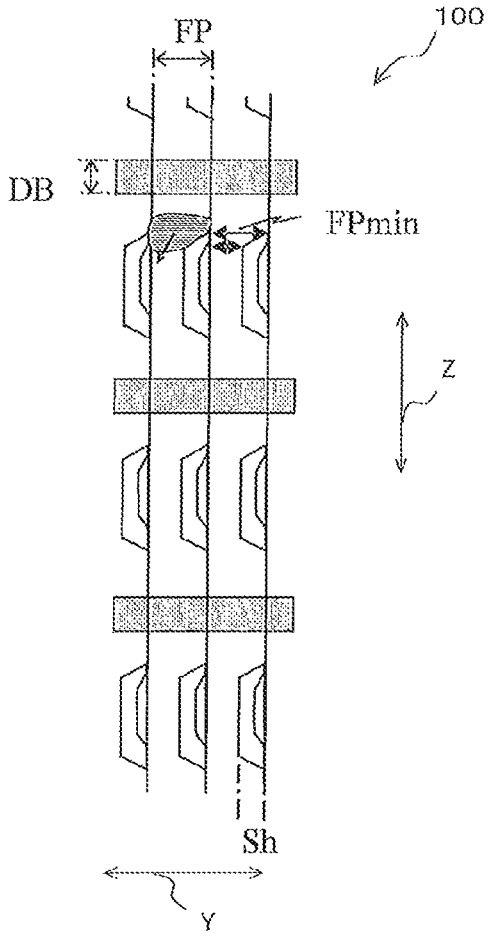
FIG. 22E is a side view illustrating the operations of the heat exchanger 100 according to Embodiment 2.
Figure 22F:
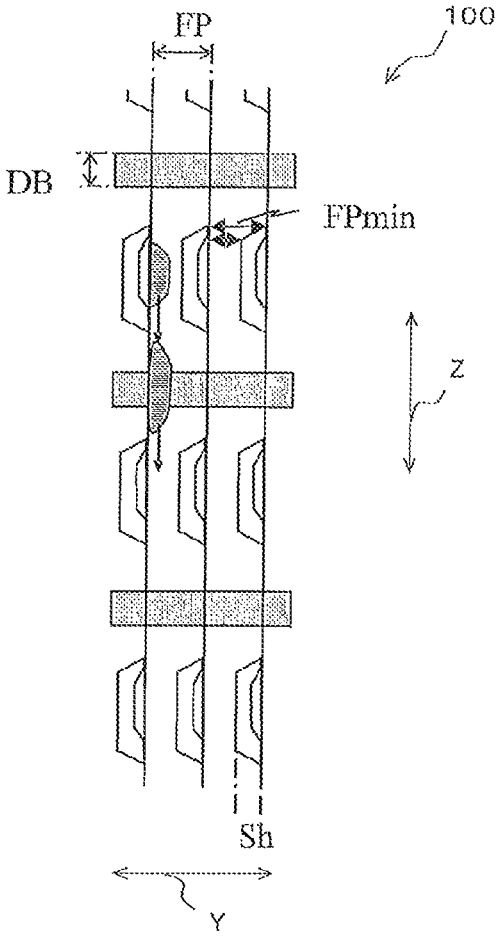
FIG. 22F is a side view illustrating the operations of the heat exchanger 100 according to Embodiment 2.

FIG. 22A to FIG. 22C are plan views illustrating the operations of the heat exchanger 100 according to Embodiment 2 of the present invention, and FIG. 22D to FIG. 22F are side views illustrating the operations of the heat exchanger 100 according to Embodiment 2 of the present invention. Next, the operations of the heat exchanger 100 according to Embodiment 2 are described.

When the amount of the water droplet is small, the gravity applied to the water droplet itself (in arrow Z1 direction) is low. Consequently, the water droplet that has separated from the lower surface 2*a* of the flat tube 2 stagnates in the narrow space FPmin between the adjacent fin 3 and the first slit raising portion 8*a*-1 due to the capillary force (FIG. 22A and FIG. 22D). When a water droplet that is located outside the cut-and-raised piece 8 in the stagnating water droplet is brought into contact with the one end 7*a* of the protruding portion 7, the water droplet is captured by the protruding portion 7 due to the capillary force (FIG. 22B and FIG. 22E). This is because the one end 7*a* is formed on the drainage region 6 side with respect to the first slit raising portion 8*a*-1 that is a part of the cut-and-raised piece 8 where the fin 3 is raised.

Then, the captured water droplet runs along the protruding portion 7 due to the capillary force and the gravity and is guided to the drainage region 6 from the cutout region 5. Then, the water droplet guided to the drainage region 6 reaches the other end 7*b*. Then, the water droplet falls onto the drainage region 6 from the other end 7*b* (FIG. 22C and FIG. 22F). The water droplet that has fallen onto the drainage region 6 descends due to the gravity while maintaining the descending speed because there is no obstacle that may be a resistance to the drainage.

As described above, in the heat exchanger 100 according to Embodiment 2, the fin 3 has the cut-and-raised piece 8 formed by cutting and raising a part of the cutout region 5 and provided with the slit raising portion that is a part where the fin 3 is raised. The one end 7*a* is formed on the drainage region 6 side with respect to the slit raising portion. Thus, the water droplet stagnating in the narrow space FPmin between the adjacent fin 3 and the slit raising portion is captured by the protruding portion 7. Then, the water droplet captured by the protruding portion 7 is guided to the drainage region 6 and is drained. Consequently, the water droplet does not stagnate on the flat tube 2 and the period of time required to reach the lower end of the heat exchanger 100 can be shortened. Thus, it is easy to reduce the water stagnation amount of the entire heat exchanger 100. Consequently, in the heat exchanger 100 according to Embodiment 2, the drainage performance for water droplets adhering to the fin 3 can be improved.

Further, the one end 7*a* is formed below the slit raising portion of the cut-and-raised piece 8 (in arrow Z1 direction). A water droplet that is located outside the cut-and-raised piece 8 in the water droplet stagnating in the narrow space FPmin between the adjacent fin 3 and the slit raising portion runs downward (in arrow Z1 direction) due to the gravity. The one end 7*a* of the protruding portion 7 is formed below the slit raising portion of the cut-and-raised piece 8 in the gravity direction (arrow Z1 direction) and consequently the capillary force for capturing the water droplet acts downward (in arrow Z1 direction). Consequently, the direction of the gravity applied to the water droplet (arrow Z1 direction) and the direction of the capillary force (arrow Z1 direction) agree with each other. Thus, the effect of promoting drainage by the protruding portion 7 is enhanced.

Moreover, the end of the cut-and-raised piece 8 on the drainage region 6 side is formed on the drainage region 6 side with respect to the center 2*d* of the flat tube 2. Thus, it is possible to reduce the distance by which a water droplet that is located outside the cut-and-raised piece 8 in the water droplet stagnating in the narrow space FPmin between the adjacent fin 3 and the slit raising portion is brought into contact with the one end 7*a*. Thus, the effect of promoting drainage by the protruding portion 7 is enhanced.

Still further, the cut-and-raised piece 8 is formed to extend perpendicularly (in arrow Z direction) to the transverse direction of the fin 3. Thus, the airflow passing between the adjacent fins 3 is not hindered. Thus, the heat exchange efficiency of the heat exchanger 100 is improved.

First Modified Example

Figure 23:
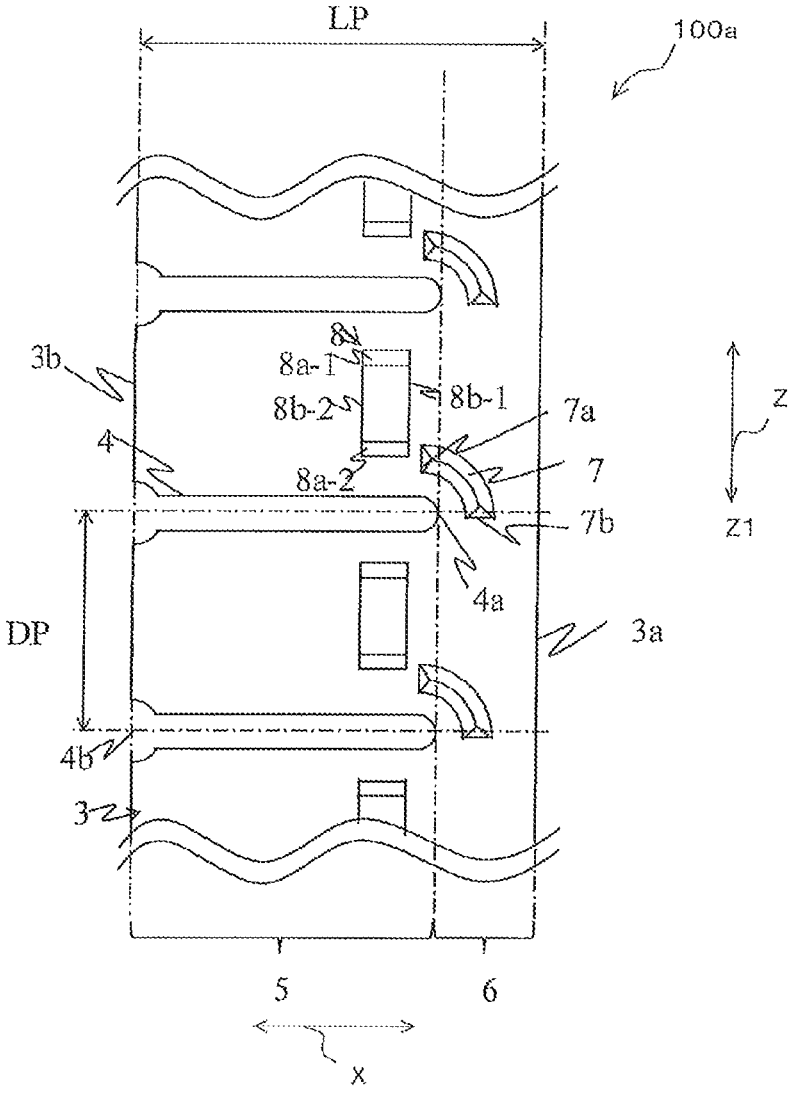
FIG. 23 is a plan view illustrating a heat exchanger 100*a* according to a first modified example of Embodiment 2 of the present invention.

FIG. 23 is a plan view illustrating a heat exchanger 100*a* according to a first modified example of Embodiment 2 of the present invention. As illustrated in FIG. 23, in the first modified example, the one end 7*a* of the protruding portion 7 is formed below the second slit raising portion 8*a*-2 in the gravity direction (arrow Z1 direction). Thus, a water droplet stagnating in the narrow space FPmin between the adjacent fin 3 and the second slit raising portion can also be captured by the protruding portion 7.

Second Modified Example

Figure 24:
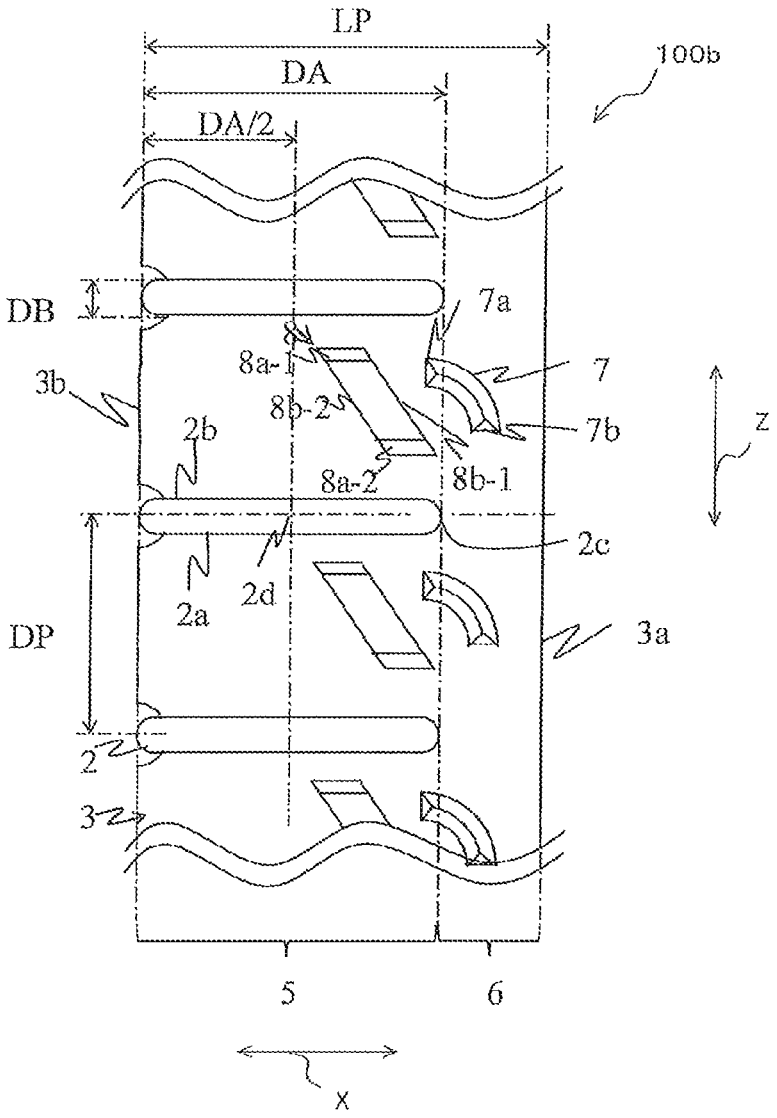
FIG. 24 is a plan view illustrating a heat exchanger 100*b* according to a second modified example of Embodiment 2 of the present invention.

FIG. 24 is a plan view illustrating a heat exchanger 100*b* according to a second modified example of Embodiment 2 of the present invention. As illustrated in FIG. 24, in the second modified example, the cutting portions are formed to extend obliquely to the transverse direction (arrow X direction) of the fin 3. In this case, advantages similar to those of Embodiment 2 are attained.

By using each of the heat exchangers 100*b* according to Embodiments 1 and 2 described above as a heat exchanger for a heat pump apparatus, it is possible to achieve a heat pump apparatus improved in heat exchange performance.

REFERENCE SIGNS LIST

1, 1*a*, 1*b*, 1*c*, 1*d*, 1*e*, 1*f*, 1*g*, 1*h* heat exchanger 2 flat tube 2*a* lower surface 2*b* upper surface 2*c* end 2*d* center 2*e* refrigerant passage fin 3*a* other side portion 4 cutout portion 4*a* deep portion 4*b* insertion portion 5 cutout region 6 drainage region 7 protruding portion 7*a* one end 7*b* other end 8 cut-and-raised piece 8*a*-1 first slit raising portion 8*a*-2 second slit raising portion 8*b*-1 first slit cutting portion 8*b*-2 second slit cutting portion 100, 100*a*, 100*b* heat exchanger 200 heat exchanger 300 heat exchanger 400 heat exchanger

The invention claimed is:

1. A heat exchanger, comprising:

a fin having a plate shape and including a first region where cutout portions are formed with intervals in a longitudinal direction, which is a gravity direction, and a second region where cutout portions are not formed in the longitudinal direction; and flat tubes attached to the cutout portions and intersecting the fin, wherein the fin has a first edge and a second edge, the second edge is opposite to the first edge, and the second edge is included in the second region, the fin has protruding portions, which protrude from a planar portion of the fin, each of the protruding portions has a first end and a second end, and each protruding portion has a shape in which the first end is located in the first region and the second end is located in the second region, the first end is located above the second end, and the second end is located below the first end, and between the first end and the second end, the protruding portion slopes in a gravitationally downward direction from the first end toward the second end such that condensation water is directed by each protruding portion from the first end to the second end and from the first region to the second region, in each protruding portion, the second end is spaced from the second edge of the fin, and the second region is planar except for the protruding portions so that the condensation water, which falls from the second end, drains along the second region without being redirected to the first region.

2. The heat exchanger of claim 1, wherein each of the protruding portions is formed into an arc shape.

3. The heat exchanger of claim 1, wherein the first end of each of the protruding portions is formed above a center of a corresponding one of the flat tubes in the longitudinal direction of the fin, and the second end is formed below the center of the corresponding one of the flat tubes in the longitudinal direction of the fin.

4. The heat exchanger of claim 1, wherein each of the protruding portions is provided between adjacent ones of the cutout portions.

5. The heat exchanger of claim 1, wherein the fin has a first slit cutting portion by which the fin is raised, a second slit cutting portion by which the fin is raised and a cut and raised piece, which connects the first slit cutting portion and the second slit cutting portion, and the first end is formed between the first slit raising portion and the second region.

6. The heat exchanger of claim 5, wherein the first end is formed below the first slit raising portion of the cut-and-raised piece.

7. The heat exchanger of claim 5, wherein an end of the cut-and raised piece on the side of the second region is formed between a center of one of the flat tubes and the second region in a transverse direction of the fin.

8. The heat exchanger of claim 5, wherein the cut-and-raised piece is formed to extend perpendicularly to a transverse direction of the fin.

9. The heat exchanger of claim 5, wherein the cut-and-raised piece is formed to extend obliquely to a transverse direction of the fin.

* * * * *